US009220328B2

(12) United States Patent
Magness

(10) Patent No.: US 9,220,328 B2
(45) Date of Patent: Dec. 29, 2015

(54) WATERPROOF PROTECTIVE CASE FOR AN ELECTRONIC DEVICE

(71) Applicant: OTTER PRODUCTS, LLC, Fort Collins, CO (US)

(72) Inventor: Cameron D. Magness, Fort Collins, CO (US)

(73) Assignee: OTTER PRODUCTS, LLC, Fort Collins, CO (US)

( * ) Notice: Subject to any disclaimer, the term of this patent is extended or adjusted under 35 U.S.C. 154(b) by 0 days.

(21) Appl. No.: 14/280,664

(22) Filed: May 18, 2014

(65) Prior Publication Data

US 2014/0339104 A1 Nov. 20, 2014

Related U.S. Application Data

(60) Provisional application No. 61/824,991, filed on May 18, 2013.

(51) Int. Cl.

| | |
|---|---|
| ***B65D 43/16*** | (2006.01) |
| ***A45C 11/00*** | (2006.01) |
| ***A45C 13/00*** | (2006.01) |

(52) U.S. Cl.

CPC ..... *A45C 11/00* (2013.01); *A45C 13/008* (2013.01); *A45C 2011/002* (2013.01); *A45C 2200/10* (2013.01)

(58) Field of Classification Search

CPC ..... A45C 13/00; A45C 11/00; B65D 43/16
USPC ..... 206/370, 320, 521, 37; 220/4.21–4.24, 220/315, 324; 361/679.01, 679.02, 679.04, 361/679.29, 679.43, 679.58

See application file for complete search history.

(56) References Cited

U.S. PATENT DOCUMENTS

| | | | |
|---|---|---|---|
| 2,392,787 | A | 1/1946 | Vermot |
| 3,023,885 | A | 3/1962 | Kindseth |
| 3,482,895 | A | 12/1969 | Becklin |
| 3,665,991 | A | 5/1972 | Gillemot et al. |
| 3,832,725 | A | 8/1974 | Cook |
| D243,698 | S | 3/1977 | Gietzen |

(Continued)

FOREIGN PATENT DOCUMENTS

| | | | |
|---|---|---|---|
| DE | 29612454 | U1 | 9/1996 |
| EP | 1018680 | A2 | 7/2000 |

(Continued)

OTHER PUBLICATIONS

Patent Search Result for U.S. Pat. No. 6,995,976.

(Continued)

*Primary Examiner* — Anthony Stashick
*Assistant Examiner* — Raven Collins

(57) ABSTRACT

A waterproof protective case can include a front portion with a cavity configured to receive a personal electronic device and a back portion configured to attach to the front portion to form the protective case. The back portion can include an over-molded gasket or a form-in-place gasket extending around a perimeter of the back portion. The front portion can include a mating surface extending around a perimeter of the cavity. The mating surface of the front portion can be configured to seal against a flexible sealing surface of the gasket when the back portion is attached to the front portion to provide a liquid-tight seal.

20 Claims, 30 Drawing Sheets

(56) References Cited

U.S. PATENT DOCUMENTS

| | | | |
|---|---|---|---|
| 4,097,878 | A | 6/1978 | Cramer |
| 4,298,204 | A | 11/1981 | Jinkins |
| 4,312,580 | A | 1/1982 | Schwomma et al. |
| 4,335,930 | A | 6/1982 | Feldman |
| 4,352,968 | A | 10/1982 | Pounds |
| D267,713 | S | 1/1983 | Noda et al. |
| 4,375,323 | A | 3/1983 | Inagaki et al. |
| 4,383,743 | A | 5/1983 | Nozawa et al. |
| 4,418,830 | A | 12/1983 | Dzung et al. |
| 4,420,078 | A | 12/1983 | Belt et al. |
| 4,546,874 | A | 10/1985 | Kirchhan |
| 4,584,718 | A | 4/1986 | Fuller |
| 4,649,453 | A | 3/1987 | Iwasawa |
| 4,658,956 | A | 4/1987 | Takeda et al. |
| 4,683,587 | A | 7/1987 | Silverman |
| 4,686,332 | A | 8/1987 | Greanias et al. |
| 4,703,161 | A | 10/1987 | Mclean |
| 4,712,657 | A | 12/1987 | Myers et al. |
| 4,733,776 | A | 3/1988 | Ward |
| 4,762,227 | A | 8/1988 | Patterson |
| 4,803,504 | A | 2/1989 | Maeno et al. |
| 4,836,256 | A | 6/1989 | Meliconi |
| 4,942,514 | A | 7/1990 | Miyagaki et al. |
| 4,963,902 | A | 10/1990 | Fukahori |
| 4,977,483 | A | 12/1990 | Perretta |
| D313,790 | S | 1/1991 | Hirabayashi |
| 4,994,829 | A | 2/1991 | Tsukamoto |
| 5,002,184 | A | 3/1991 | Lloyd |
| D316,932 | S | 5/1991 | Escher, Jr. |
| 5,025,921 | A | 6/1991 | Gasparaitis et al. |
| D322,165 | S | 12/1991 | Lloyd |
| 5,087,934 | A | 2/1992 | Johnson |
| 5,092,458 | A | 3/1992 | Yokoyama |
| 5,092,459 | A | 3/1992 | Uljanic et al. |
| D328,280 | S | 7/1992 | Lee |
| 5,175,873 | A | 12/1992 | Goldenberg et al. |
| 5,177,515 | A | 1/1993 | Tsukamoto |
| 5,231,381 | A | 7/1993 | Duwaer |
| 5,232,502 | A | 8/1993 | Recker |
| 5,239,323 | A | 8/1993 | Johnson |
| 5,239,324 | A | 8/1993 | Ohmura et al. |
| 5,285,894 | A | 2/1994 | Kamata et al. |
| 5,294,988 | A | 3/1994 | Wakabayashi et al. |
| 5,305,032 | A | 4/1994 | Arai |
| 5,336,896 | A | 8/1994 | Katz |
| 5,360,108 | A | 11/1994 | Alagia |
| 5,368,159 | A | 11/1994 | Doria |
| 5,380,968 | A | 1/1995 | Morse |
| 5,383,091 | A | 1/1995 | Snell |
| 5,386,084 | A | 1/1995 | Risko |
| 5,388,691 | A | 2/1995 | White |
| 5,388,692 | A | 2/1995 | Withrow et al. |
| D365,927 | S | 1/1996 | Cho |
| 5,505,328 | A | 4/1996 | Stribiak |
| 5,508,479 | A | 4/1996 | Schooley |
| 5,541,813 | A | 7/1996 | Satoh et al. |
| RE35,318 | E | 8/1996 | Warman |
| 5,548,306 | A | 8/1996 | Yates et al. |
| 5,583,742 | A | 12/1996 | Noda et al. |
| 5,584,054 | A | 12/1996 | Tyneski et al. |
| 5,590,760 | A | 1/1997 | Astarb |
| 5,610,655 | A | 3/1997 | Wakabayashi et al. |
| D378,634 | S | 4/1997 | LaPere |
| 5,636,101 | A | 6/1997 | Bonsall et al. |
| 5,669,004 | A | 9/1997 | Sellers |
| 5,681,122 | A | 10/1997 | Burke |
| 5,707,757 | A | 1/1998 | Lee |
| 5,713,048 | A | 1/1998 | Hayakawa |
| 5,713,466 | A | 2/1998 | Tajima |
| D399,185 | S | 10/1998 | Lin |
| 5,845,803 | A | 12/1998 | Saito et al. |
| 5,850,915 | A | 12/1998 | Tajima |
| 5,907,721 | A | 5/1999 | Schelling et al. |
| 5,946,501 | A | 8/1999 | Hayakawa |
| 5,956,291 | A | 9/1999 | Nehemiah et al. |
| 5,982,520 | A | 11/1999 | Weiser et al. |
| 5,990,874 | A | 11/1999 | Tsumura et al. |
| D419,297 | S | 1/2000 | Richardson et al. |
| D419,768 | S | 2/2000 | Richardson et al. |
| 6,041,924 | A | 3/2000 | Tajima |
| D424,035 | S | 5/2000 | Steiner et al. |
| 6,068,119 | A | 5/2000 | Derr et al. |
| 6,092,707 | A | 7/2000 | Bowes, Jr. |
| 6,094,785 | A | 8/2000 | Montgomery et al. |
| 6,128,441 | A | 10/2000 | Kamata et al. |
| 6,132,367 | A | 10/2000 | Adair |
| 6,201,867 | B1 | 3/2001 | Koike |
| D447,634 | S | 9/2001 | Snider |
| 6,304,459 | B1 | 10/2001 | Toyosato et al. |
| 6,311,017 | B1 | 10/2001 | Mori |
| 6,313,982 | B1 | 11/2001 | Hino |
| 6,317,313 | B1 | 11/2001 | Mosgrove et al. |
| 6,349,824 | B1 | 2/2002 | Yamada |
| 6,388,877 | B1 | 5/2002 | Canova et al. |
| 6,396,769 | B1 | 5/2002 | Polany |
| 6,415,138 | B2 | 7/2002 | Sirola et al. |
| 6,445,577 | B1 | 9/2002 | Madsen et al. |
| 6,456,487 | B1 | 9/2002 | Hetterick |
| D464,196 | S | 10/2002 | Parker |
| 6,471,056 | B1 | 10/2002 | Tzeng |
| 6,519,141 | B2 | 2/2003 | Tseng et al. |
| 6,525,928 | B1 | 2/2003 | Madsen et al. |
| 6,532,152 | B1 | 3/2003 | White et al. |
| 6,536,589 | B2 | 3/2003 | Chang |
| 6,571,056 | B2 | 5/2003 | Shimamura et al. |
| D475,348 | S | 6/2003 | D'Addario et al. |
| 6,574,434 | B2 | 6/2003 | Matsuoto et al. |
| 6,594,472 | B1 | 7/2003 | Curtis et al. |
| 6,595,608 | B1 | 7/2003 | Minelli et al. |
| 6,597,865 | B1 | 7/2003 | Negishi et al. |
| 6,614,423 | B1 | 9/2003 | Wong et al. |
| 6,614,722 | B2 | 9/2003 | Polany et al. |
| 6,616,111 | B1 | 9/2003 | White |
| 6,617,973 | B1 | 9/2003 | Osterman |
| 6,625,394 | B2 | 9/2003 | Smith et al. |
| 6,634,494 | B1 | 10/2003 | Derr et al. |
| 6,636,697 | B2 | 10/2003 | Smith et al. |
| 6,646,864 | B2 | 11/2003 | Richardson |
| 6,659,274 | B2 | 12/2003 | Enners |
| 6,665,174 | B1 | 12/2003 | Derr et al. |
| 6,669,017 | B2 | 12/2003 | Linihan |
| 6,698,608 | B2 | 3/2004 | Parker et al. |
| 6,721,651 | B1 | 4/2004 | Minelli |
| 6,751,552 | B1 | 6/2004 | Minelli |
| 6,760,570 | B1 | 7/2004 | Higdon, Jr. |
| 6,778,388 | B1 | 8/2004 | Minelli |
| 6,785,566 | B1 | 8/2004 | Irizarry |
| 6,819,866 | B2 | 11/2004 | Silva |
| 6,822,161 | B2 | 11/2004 | Komatsu et al. |
| 6,822,640 | B2 | 11/2004 | Derocher |
| 6,844,845 | B1 | 1/2005 | Whiteside et al. |
| 6,913,201 | B1 | 7/2005 | Wagner et al. |
| 6,914,774 | B1 | 7/2005 | Albertini et al. |
| D507,871 | S | 8/2005 | Dimarchi et al. |
| 6,953,126 | B2 | 10/2005 | Parker et al. |
| 6,954,405 | B2 | 10/2005 | Polany et al. |
| 6,955,293 | B1 | 10/2005 | Katsanevas |
| 6,971,517 | B2 | 12/2005 | Chen |
| 6,975,888 | B2 | 12/2005 | Buesseler et al. |
| 6,980,777 | B2 | 12/2005 | Shepherd et al. |
| 6,983,130 | B2 | 1/2006 | Chien et al. |
| 6,987,527 | B2 | 1/2006 | Kossin |
| 6,992,659 | B2 | 1/2006 | Gettemy |
| 6,995,976 | B2 | 2/2006 | Richardson |
| D516,807 | S | 3/2006 | Richardson et al. |
| 7,046,230 | B2 | 5/2006 | Zadesky et al. |
| 7,050,712 | B2 | 5/2006 | Shimamura |
| 7,050,841 | B1 | 5/2006 | Onda |
| 7,054,441 | B2 | 5/2006 | Pletikosa |
| 7,061,762 | B2 | 6/2006 | Canova, Jr. et al. |
| 7,069,063 | B2 | 6/2006 | Halkosaari et al. |
| 7,082,264 | B2 | 7/2006 | Watanabe et al. |
| 7,085,542 | B2 | 8/2006 | Dietrich et al. |
| 7,089,547 | B2 | 8/2006 | Goodman et al. |

(56) References Cited

U.S. PATENT DOCUMENTS

| | | | |
|---|---|---|---|
| 7,106,959 | B2 | 9/2006 | Sato |
| D530,079 | S | 10/2006 | Thomas et al. |
| 7,146,701 | B2 | 12/2006 | Mahoney et al. |
| 7,158,376 | B2 | 1/2007 | Richardson et al. |
| 7,180,735 | B2 | 2/2007 | Thomas et al. |
| 7,194,086 | B2 | 3/2007 | Pletikosa |
| 7,194,202 | B2 | 3/2007 | Funahashi et al. |
| 7,194,291 | B2 | 3/2007 | Peng |
| D543,509 | S | 5/2007 | Victor |
| 7,230,823 | B2 | 6/2007 | Richardson et al. |
| 7,236,588 | B2 | 6/2007 | Gartrell |
| 7,255,228 | B2 | 8/2007 | Kim |
| 7,263,032 | B2 | 8/2007 | Polany et al. |
| D550,623 | S | 9/2007 | McCann |
| 7,312,984 | B2 | 12/2007 | Richardson et al. |
| 7,341,144 | B2 | 3/2008 | Tajiri et al. |
| 7,343,184 | B2 | 3/2008 | Rostami |
| 7,352,961 | B2 | 4/2008 | Watanabe et al. |
| 7,362,570 | B2 | 4/2008 | Su |
| 7,365,281 | B2 | 4/2008 | Yamaguchi et al. |
| 7,366,555 | B2 | 4/2008 | Jokinen et al. |
| 7,369,881 | B2 | 5/2008 | Tsujimoto |
| 7,389,869 | B2 | 6/2008 | Mason |
| 7,400,917 | B2 | 7/2008 | Wood et al. |
| D574,819 | S | 8/2008 | Andre et al. |
| D575,056 | S | 8/2008 | Tan |
| 7,409,148 | B2 | 8/2008 | Takahashi et al. |
| 7,418,278 | B2 | 8/2008 | Eriksson et al. |
| 7,428,427 | B2 | 9/2008 | Brunstrom et al. |
| 7,436,653 | B2 | 10/2008 | Yang et al. |
| D581,421 | S | 11/2008 | Richardson |
| D582,149 | S | 12/2008 | Tan |
| 7,464,813 | B2 | 12/2008 | Carnevali |
| 7,464,814 | B2 | 12/2008 | Carnevali |
| 7,495,659 | B2 | 2/2009 | Marriott et al. |
| 7,495,895 | B2 | 2/2009 | Carnevali |
| 7,499,040 | B2 | 3/2009 | Zadesky et al. |
| 7,502,550 | B2 | 3/2009 | Ariga |
| 7,511,956 | B2 | 3/2009 | Tomioka et al. |
| 7,525,792 | B2 | 4/2009 | Yokote |
| 7,535,799 | B2 | 5/2009 | Polany et al. |
| D593,319 | S | 6/2009 | Richardson et al. |
| 7,558,594 | B2 | 7/2009 | Wilson |
| 7,594,576 | B2 | 9/2009 | Chen et al. |
| 7,609,512 | B2 | 10/2009 | Richardson et al. |
| 7,613,386 | B2 | 11/2009 | Shimamura |
| 7,623,898 | B2 | 11/2009 | Holmberg |
| D605,850 | S | 12/2009 | Richardson et al. |
| 7,630,746 | B2 | 12/2009 | Holmberg |
| 7,653,292 | B2 | 1/2010 | Yamaguchi et al. |
| 7,663,878 | B2 | 2/2010 | Swan et al. |
| 7,663,879 | B2 | 2/2010 | Richardson et al. |
| 7,679,674 | B2 | 3/2010 | Nishizawa |
| 7,688,580 | B2 | 3/2010 | Richardson et al. |
| 7,697,269 | B2 | 4/2010 | Yang et al. |
| D616,430 | S | 5/2010 | Fathollahi |
| 7,711,400 | B2 | 5/2010 | Nuovo |
| 7,733,642 | B2 | 6/2010 | Liou et al. |
| 7,755,975 | B2 | 7/2010 | Pettersen et al. |
| 7,772,507 | B2 | 8/2010 | Orr et al. |
| 7,775,354 | B2 | 8/2010 | Latchford et al. |
| 7,787,756 | B2 | 8/2010 | Funahashi et al. |
| 7,789,228 | B2 | 9/2010 | Zenzai |
| 7,789,696 | B2 | 9/2010 | Umei et al. |
| 7,801,425 | B2 | 9/2010 | Fantone et al. |
| 7,850,032 | B2 | 12/2010 | Carnevali et al. |
| 7,854,434 | B2 | 12/2010 | Heiman et al. |
| 7,889,489 | B2 | 2/2011 | Richardson et al. |
| 7,907,394 | B2 | 3/2011 | Johnson et al. |
| 7,926,818 | B2 | 4/2011 | Isono |
| 7,933,122 | B2 | 4/2011 | Richardson et al. |
| 7,936,566 | B2 | 5/2011 | Shigyo et al. |
| 7,941,196 | B2 | 5/2011 | Kawasaki et al. |
| 7,944,697 | B2 | 5/2011 | Hata et al. |
| 7,975,870 | B2 | 7/2011 | Laule et al. |
| 7,978,092 | B2 | 7/2011 | Osaka |
| 7,993,071 | B2 | 8/2011 | Clawson |
| D644,636 | S | 9/2011 | Richardson et al. |
| 8,024,015 | B2 | 9/2011 | Araki et al. |
| 8,031,472 | B2 | 10/2011 | Bicket et al. |
| 8,032,194 | B2 | 10/2011 | Liu et al. |
| 8,053,668 | B2 | 11/2011 | Lai et al. |
| 8,068,331 | B2 | 11/2011 | Sauers et al. |
| 8,089,757 | B2 | 1/2012 | Chen et al. |
| 8,138,434 | B2 | 3/2012 | Tang et al. |
| 8,164,899 | B2 | 4/2012 | Yamaguchi et al. |
| 8,167,126 | B2 | 5/2012 | Stiehl |
| 8,191,706 | B1 * | 6/2012 | Liu ..... 206/320 |
| 8,204,561 | B2 | 6/2012 | Mongan et al. |
| 8,223,997 | B2 | 7/2012 | Wilson, II et al. |
| 8,245,842 | B2 | 8/2012 | Bau |
| 8,251,210 | B2 | 8/2012 | Schmidt et al. |
| 8,265,264 | B2 | 9/2012 | Yamaguchi et al. |
| 8,269,104 | B2 | 9/2012 | Choraku et al. |
| 8,286,789 | B2 | 10/2012 | Wilson et al. |
| 8,311,595 | B2 | 11/2012 | Takatsuka et al. |
| 8,342,325 | B2 * | 1/2013 | Rayner ..... 206/320 |
| 8,373,980 | B2 | 2/2013 | Reber |
| 8,393,466 | B2 | 3/2013 | Rayner |
| 8,400,408 | B2 | 3/2013 | Hotelling |
| 8,430,240 | B2 | 4/2013 | Kim |
| D682,817 | S * | 5/2013 | Murchison et al. ..... D14/250 |
| 8,454,101 | B2 | 6/2013 | Kuo |
| 2001/0040109 | A1 | 11/2001 | Yaski et al. |
| 2002/0003584 | A1 | 1/2002 | Kossin |
| 2002/0009195 | A1 | 1/2002 | Schon |
| 2002/0065054 | A1 | 5/2002 | Humphreys et al. |
| 2002/0071550 | A1 | 6/2002 | Pletikosa |
| 2002/0079244 | A1 | 6/2002 | Kwong |
| 2002/0085709 | A1 | 7/2002 | Hsu |
| 2002/0090212 | A1 | 7/2002 | Shimamura et al. |
| 2002/0122353 | A1 | 9/2002 | Polany et al. |
| 2002/0136557 | A1 | 9/2002 | Shimamura |
| 2002/0137475 | A1 | 9/2002 | Shou et al. |
| 2002/0175096 | A1 | 11/2002 | Linihan |
| 2002/0175901 | A1 | 11/2002 | Gettemy |
| 2002/0193136 | A1 | 12/2002 | Halkosaari et al. |
| 2002/0195910 | A1 | 12/2002 | Hus et al. |
| 2003/0080947 | A1 | 5/2003 | Genest et al. |
| 2003/0095374 | A1 | 5/2003 | Richardson |
| 2003/0111366 | A1 | 6/2003 | Enners |
| 2003/0118332 | A1 | 6/2003 | Smith et al. |
| 2003/0118334 | A1 | 6/2003 | Smith et al. |
| 2003/0128397 | A1 | 7/2003 | Smith et al. |
| 2003/0223577 | A1 | 12/2003 | Ono |
| 2004/0014506 | A1 | 1/2004 | Kemppinen |
| 2004/0076415 | A1 | 4/2004 | Da Silva |
| 2004/0089570 | A1 | 5/2004 | Chien et al. |
| 2004/0120219 | A1 | 6/2004 | Polany et al. |
| 2004/0188120 | A1 | 9/2004 | Komatsu et al. |
| 2004/0203502 | A1 | 10/2004 | Dietrich et al. |
| 2004/0226836 | A1 | 11/2004 | Schreiber et al. |
| 2005/0052425 | A1 | 3/2005 | Zadesky et al. |
| 2005/0094024 | A1 | 5/2005 | Sato |
| 2005/0110768 | A1 | 5/2005 | Marriott et al. |
| 2005/0115852 | A1 | 6/2005 | Funahashi et al. |
| 2005/0123161 | A1 | 6/2005 | Polany et al. |
| 2005/0167304 | A1 | 8/2005 | Shimamura |
| 2005/0174727 | A1 | 8/2005 | Thomas et al. |
| 2005/0181843 | A1 | 8/2005 | Tsujimoto |
| 2005/0224508 | A1 | 10/2005 | Tajiri et al. |
| 2005/0247584 | A1 | 11/2005 | Lu |
| 2005/0279661 | A1 | 12/2005 | Hodges |
| 2006/0008261 | A1 | 1/2006 | Watanabe et al. |
| 2006/0110146 | A1 | 5/2006 | Ariga |
| 2006/0255493 | A1 | 11/2006 | Fouladpour |
| 2007/0040931 | A1 | 2/2007 | Nishizawa |
| 2007/0071423 | A1 | 3/2007 | Fantone et al. |
| 2007/0074473 | A1 | 4/2007 | Yamaguchi et al. |
| 2007/0086273 | A1 | 4/2007 | Polany et al. |
| 2007/0109730 | A1 | 5/2007 | Shigyo et al. |
| 2007/0110416 | A1 | 5/2007 | Yamaguchi et al. |
| 2007/0115387 | A1 | 5/2007 | Ho |
| 2007/0138920 | A1 | 6/2007 | Austin et al. |

(56) References Cited

U.S. PATENT DOCUMENTS

| | | | |
|---|---|---|---|
| 2007/0146985 | A1 | 6/2007 | Mick et al. |
| 2007/0158220 | A1 | 7/2007 | Cleereman et al. |
| 2007/0215663 | A1 | 9/2007 | Chongson et al. |
| 2007/0241012 | A1 | 10/2007 | Latchford et al. |
| 2007/0261976 | A1 | 11/2007 | Anderson |
| 2007/0261978 | A1 | 11/2007 | Sanderson |
| 2007/0280053 | A1 | 12/2007 | Polany et al. |
| 2007/0297149 | A1 | 12/2007 | Richardson et al. |
| 2008/0081679 | A1 | 4/2008 | Kawasaki et al. |
| 2008/0157485 | A1 | 7/2008 | Isono |
| 2008/0164267 | A1 | 7/2008 | Huber |
| 2009/0009945 | A1 | 1/2009 | Johnson et al. |
| 2009/0017884 | A1 | 1/2009 | Rotschild |
| 2009/0028535 | A1 | 1/2009 | Funahashi et al. |
| 2009/0032420 | A1 | 2/2009 | Zenzai |
| 2009/0034169 | A1 | 2/2009 | Richardson et al. |
| 2009/0087655 | A1 | 4/2009 | Yamada et al. |
| 2009/0090532 | A1 | 4/2009 | Lai et al. |
| 2009/0109635 | A1 | 4/2009 | Chen et al. |
| 2009/0117957 | A1 | 5/2009 | Araki et al. |
| 2009/0167545 | A1 | 7/2009 | Osaka |
| 2009/0211775 | A1 | 8/2009 | Yamaguchi et al. |
| 2009/0215412 | A1 | 8/2009 | Liu et al. |
| 2009/0260844 | A1 | 10/2009 | Tseng |
| 2010/0006314 | A1 | 1/2010 | Wilson, II et al. |
| 2010/0044198 | A1 | 2/2010 | Tang et al. |
| 2010/0085691 | A1 | 4/2010 | Yeh et al. |
| 2010/0093412 | A1 | 4/2010 | Serra et al. |
| 2010/0144194 | A1 | 6/2010 | Umei et al. |
| 2010/0147737 | A1 | 6/2010 | Richardson et al. |
| 2010/0181108 | A1 | 7/2010 | Hata et al. |
| 2010/0203931 | A1 | 8/2010 | Hynecek et al. |
| 2010/0206601 | A1 | 8/2010 | Choraku et al. |
| 2010/0238119 | A1 | 9/2010 | Dubrovsky et al. |
| 2010/0311475 | A1 | 12/2010 | Takatsuka et al. |
| 2010/0313485 | A1 | 12/2010 | Kuo |
| 2011/0002106 | A1 | 1/2011 | Bentley et al. |
| 2011/0017620 | A1 | 1/2011 | Latchford et al. |
| 2011/0024315 | A1 | 2/2011 | Kim |
| 2011/0228460 | A1 | 9/2011 | Kim et al. |
| 2012/0018325 | A1 | 1/2012 | Kim |
| 2012/0031914 | A1 | 2/2012 | Liu |
| 2012/0043235 | A1 | 2/2012 | Klement |
| 2012/0099261 | A1 | 4/2012 | Reber |
| 2012/0099262 | A1 | 4/2012 | Reber et al. |
| 2012/0099265 | A1 | 4/2012 | Reber |
| 2012/0099266 | A1 | 4/2012 | Reber et al. |
| 2012/0103844 | A1 | 5/2012 | Piedra et al. |
| 2012/0118773 | A1 | 5/2012 | Rayner |
| 2012/0168336 | A1 | 7/2012 | Schmidt et al. |
| 2012/0211382 | A1 | 8/2012 | Rayner |
| 2012/0314354 | A1 | 12/2012 | Rayner |
| 2013/0027862 | A1 | 1/2013 | Rayner |
| 2013/0077226 | A1 | 3/2013 | Rayner |
| 2013/0088130 | A1 | 4/2013 | Rayner |
| 2013/0220841 | A1 | 8/2013 | Yang |
| 2014/0262848 | A1 | 9/2014 | Fathollahi et al. |

FOREIGN PATENT DOCUMENTS

| | | | |
|---|---|---|---|
| JP | 05061069 | U | 8/1993 |
| JP | H0818637 | A | 1/1996 |
| JP | 2000341383 | A | 12/2000 |
| JP | 2003164316 | A | 6/2003 |
| WO | 9400037 | A | 1/1994 |
| WO | 9600037 | A | 1/1996 |
| WO | 0051315 | A | 8/2000 |
| WO | 0211161 | A | 2/2002 |
| WO | 2012074151 | A | 6/2012 |

OTHER PUBLICATIONS

Intl. Search Report and Written Opinion dated Jun. 18, 2015 for PCT/US14/038527.

* cited by examiner

WATERPROOF PROTECTIVE CASE FOR AN ELECTRONIC DEVICE

CROSS-REFERENCE TO RELATED APPLICATIONS

This application claims the benefit of U.S. Patent Application No. 61/824,991, filed May 18, 2013, which is hereby incorporated by reference in its entirety.

BACKGROUND

Personal electronic devices are often used for communication and entertainment purposes. Examples of personal electronic devices include smartphones, tablets, audio players, video players, cameras, portable computers, two-way radios, and GPS receivers. To protect an electronic device from damage resulting from everyday use, a protective case can be installed around the device.

BRIEF DESCRIPTIONS OF DRAWINGS

Figure 28:
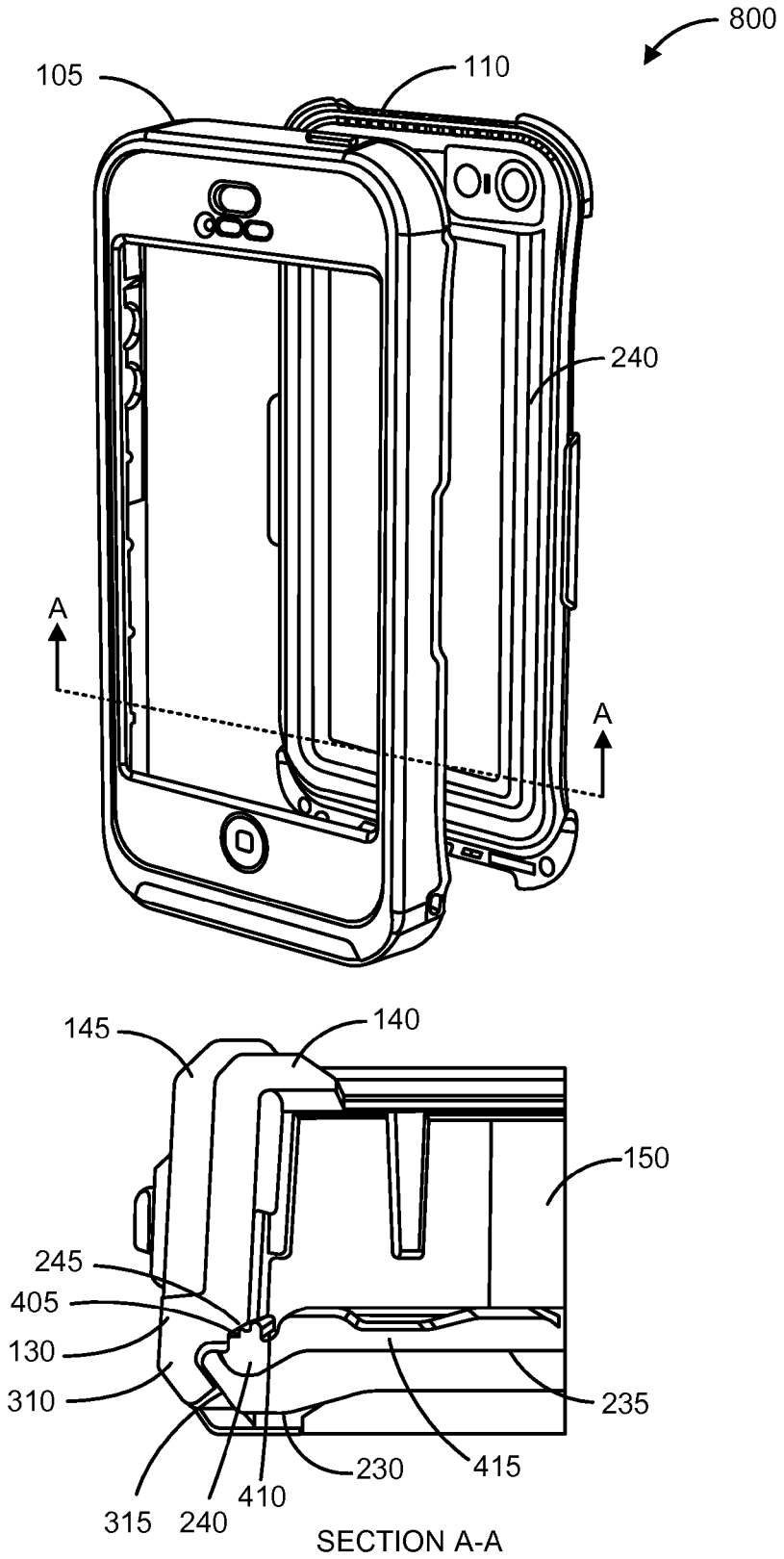

FIG. 28 includes an upper view and a lower view. The upper view shows a front perspective view of a second embodiment of a protective case for an electronic device in a disassembled state. The lower view shows a partial cross-sectional view of the second embodiment taken along Section A-A when the protective case is in an assembled state with the front portion connected to the back portion.

Figure 29:
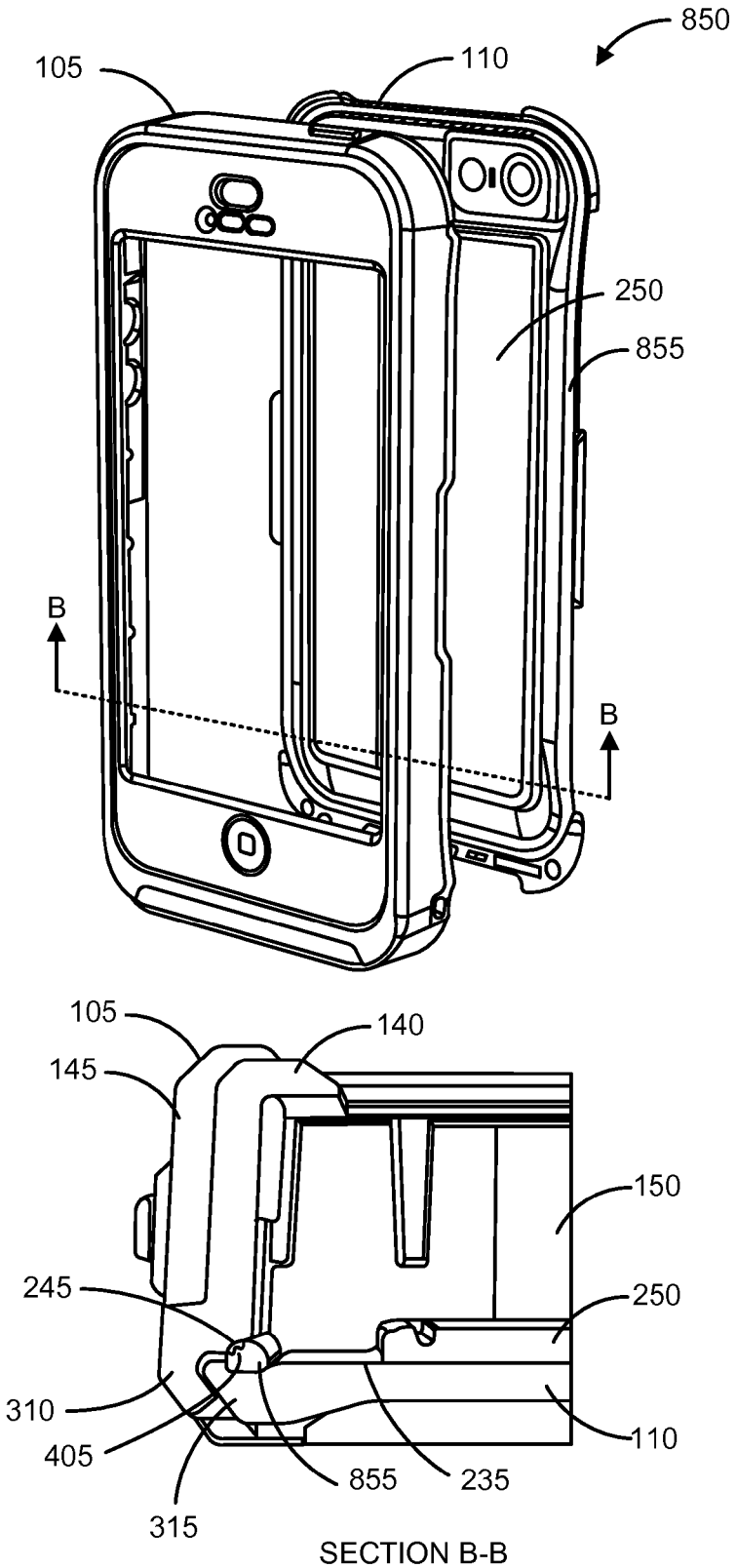

FIG. 29 includes an upper view and a lower view. The upper view shows a front perspective view of a third embodiment of a protective case for an electronic device in a disassembled state. The lower view shows a partial cross-sectional view of the third embodiment taken along Section B-B when the protective case is in an assembled state with the front portion connected to the back portion.

Figure 30:
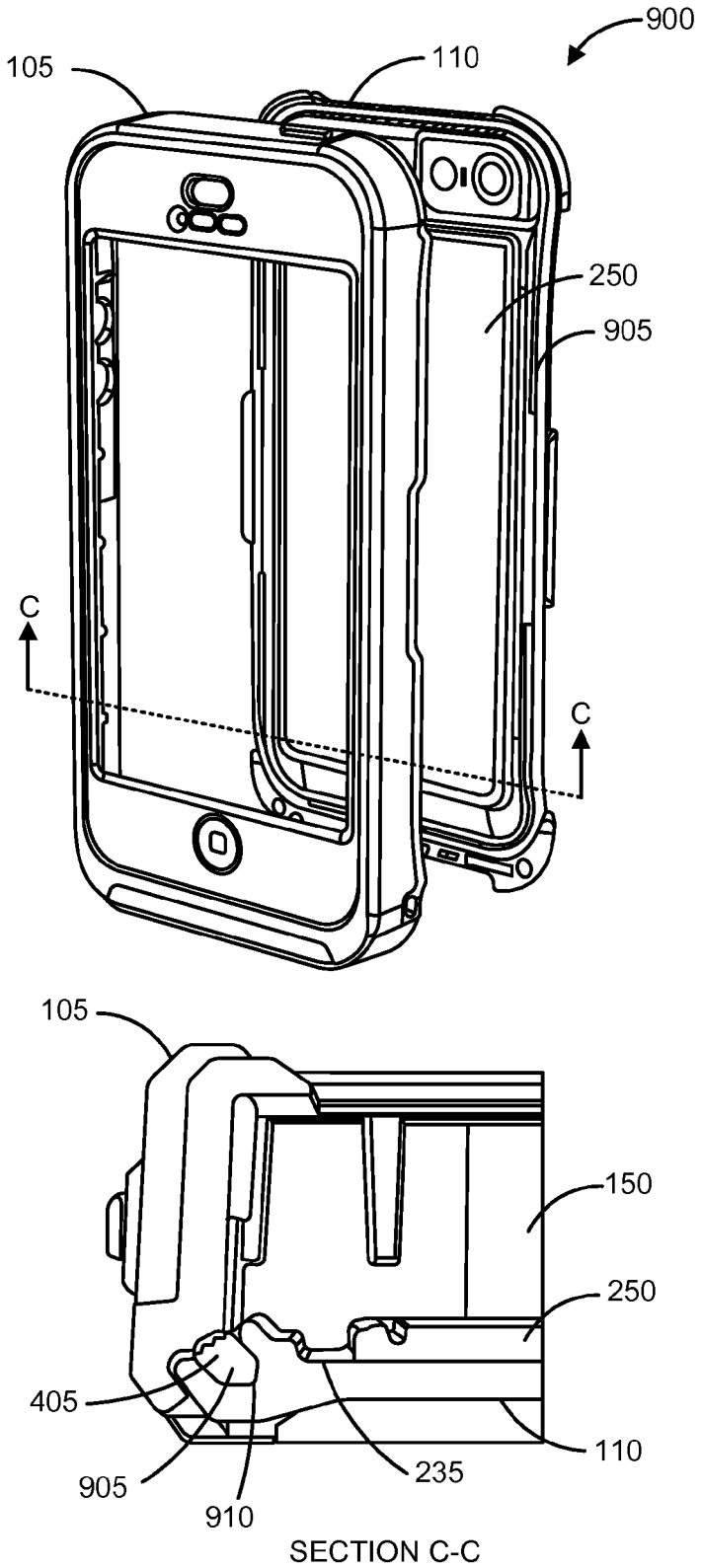

FIG. 30 includes an upper view and a lower view. The upper view shows a front perspective view of a fourth embodiment of a protective case for an electronic device in a disassembled state. The lower view shows a partial cross-sectional view of the fourth embodiment taken along Section C-C when the protective case is in an assembled state with the front portion connected to the back portion.

DETAILED DESCRIPTION

A protective case 100 for a personal electronic device, such as a smartphone, can include a front portion 105 and a back portion 110. The back portion 110 can attach to the front portion 105 to form a protective case 100. FIGS. 1-12 show the protective case 100 with the front portion 105 attached to the back portion 110, FIGS. 13-22 show the front portion 105 only, and FIGS. 23-27 show the back portion 110 only. In one example, the back portion 110 can attach to the front portion 105 to form a water-resistant protective case 100 that protects an electronic device from damage that would otherwise result from being dropped onto a hard surface from a moderate distance (e.g. dropping from a user's hand onto a tile or concrete surface) or exposure to liquids (e.g. submersion in a swimming pool or contact with a spilled beverage).

Figure 13:
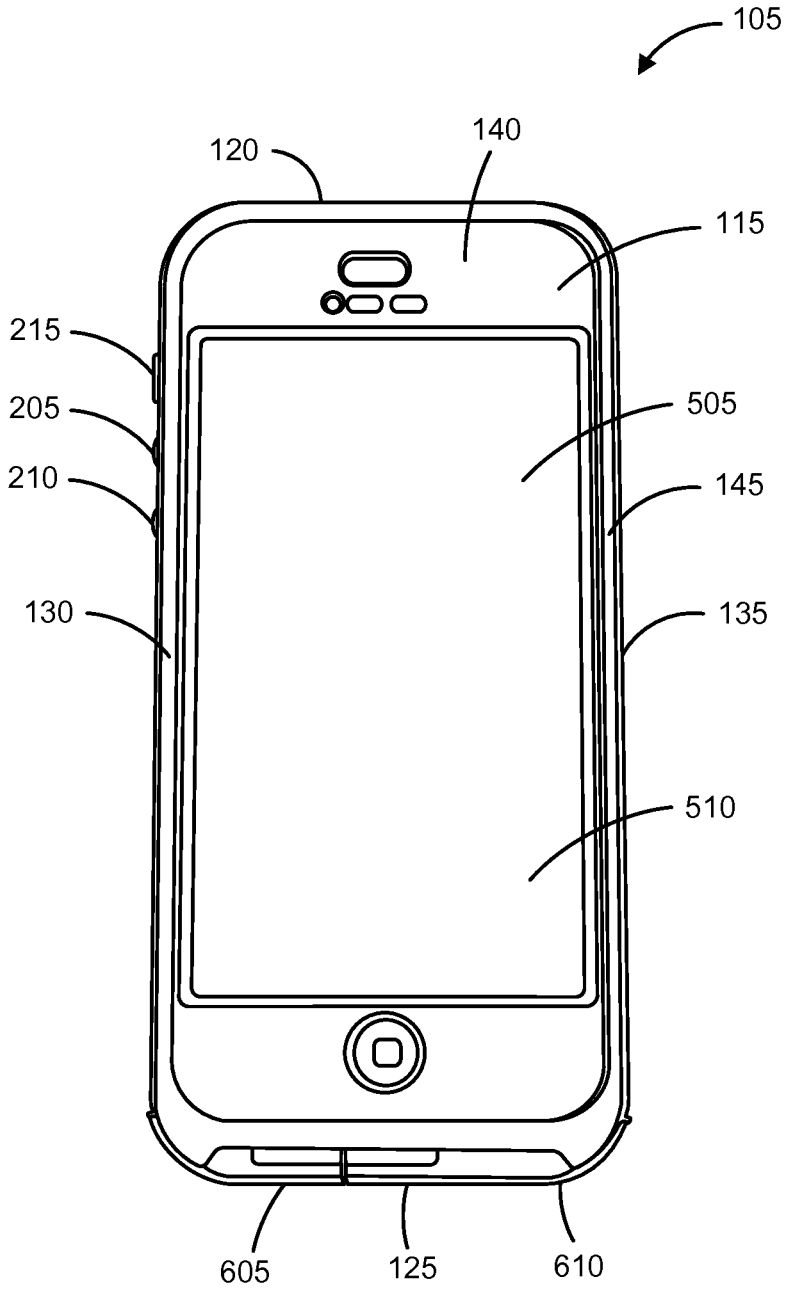
FIG. 13 is a front view of a front portion of the protective case of FIG. 1.
Figure 14:
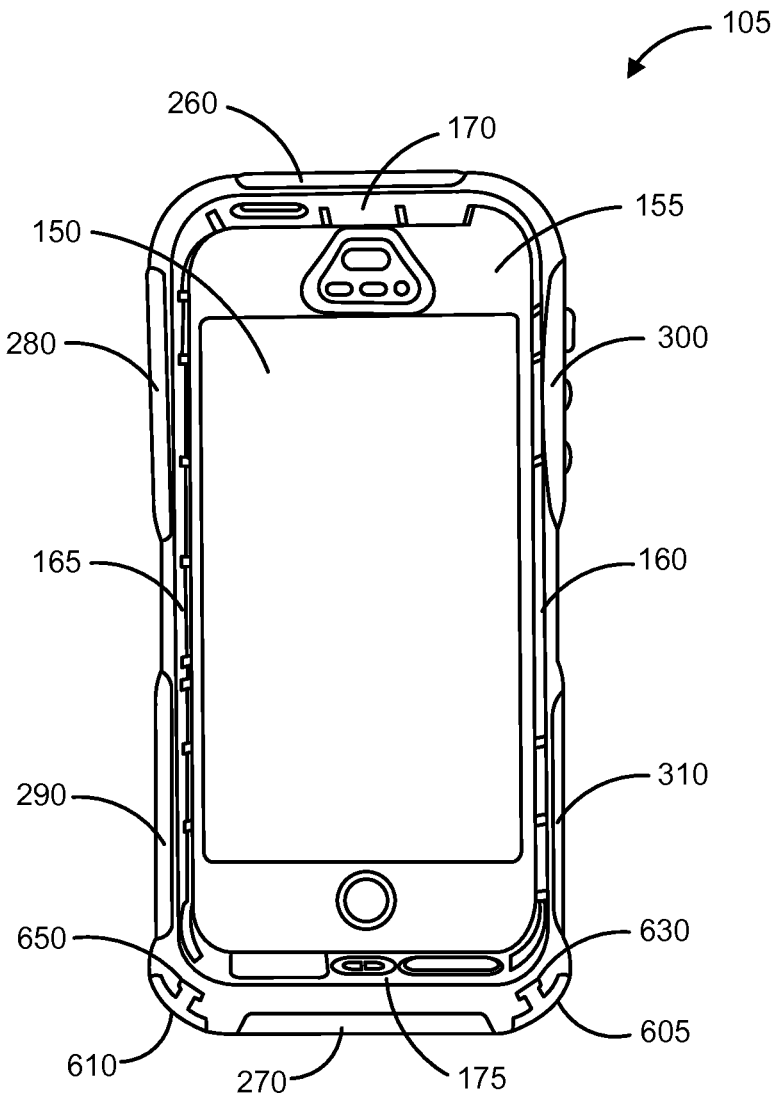
FIG. 14 is a back view of the front portion of the protective case of FIG. 1.

As shown in FIG. 13, the front portion 105 can have a front side surface 115, a top side surface 120, a bottom side surface 125, a left side surface 130, and a right side surface 135. As shown in FIG. 14, the back side of the front portion 105 can include a cavity 150 configured to receive a personal electronic device. The cavity 150 in the front portion 105 can be defined by an inner front side surface 155, an inner left side surface 160, an inner right side surface 165, an inner top side surface 170, and an inner bottom side surface 175.

The front portion 105 can include a front opening 505, as shown in FIG. 13. A transparent membrane 510 can be attached to the front portion 105 and can cover the front opening 505. The membrane 510 can be made of any suitable material that permits the user to interact with the display screen of the electronic device through the membrane 510. In one example, the membrane 510 can be made from a thin layer of thermoplastic polycarbonate (e.g. LEXAN), polyvinylchloride, high-strength alkali-aluminosilicate thin sheet glass (e.g. GORILLA GLASS), urethane, silicon, polyethylene terephthalate (PET), or any other suitable material. The membrane 510 can be formed using any suitable manufacturing process, such as thermoforming, casting, stretching, heating, or injection molding. In one example, the membrane 510 can include a thin, transparent, flexible layer of polyurethane, which can serve as a clear screen protector with desirable optical qualities (e.g. high transparency and low reflectivity). The membrane 510 can have any suitable thickness. In one example, the membrane 510 can have a thickness of about 0.001-0.100, 0.001-0.050, 0.004-0.020, 0.005-0.015, or 0.005-0.010 inches. The membrane 510 can have a microtextured surface to reduce glare. The membrane 510 can include an oleophobic surface coating on its outer surface to minimize the appearance of fingerprints or oily smudges on the membrane, thereby allowing the screen of the electronic device to be clearly viewed through the membrane without unwanted obstructions.

The front portion 105 can include a first layer and a second layer. In one example, the second layer 145 can be overmolded onto the first layer 140. The first layer 140 can be made of a relatively hard material and the second layer 145 can be a relatively soft material. The first layer 140 can be made of any suitable material, including, but not limited to, polycarbonate (PC), high impact polystyrene (HIPS), nylon, fiberglass-filled nylon, acrylonitrile butadiene styrene (ABS), polyoxymethylene (POM), polyethylene terephthalate (PET), aluminum, aluminum alloy, titanium, wood, carbon fiber, or any combination thereof. The second layer 145 can be made of any suitable material, such as a thermoplastic elastomer. The first layer 140 can bolster the structural rigidity of the protective case 100 to enable the case to withstand a moderate drop (e.g. from a height of about 3-6 feet) without experiencing significant physical deformation upon impact, thereby ensuring that unwanted separation of the front portion 105 from the back portion 110 does not occur at impact. Separation of the front portion 105 from the back portion 110 (i.e. unwanted disassembly) is undesirable, since the electronic device will typically exit the cavity 150 of the front portion and then be unprotected and vulnerable to scratching or shattering as it makes direct contact with the ground.

The second layer 145 of the front portion 105 can be made of a relatively soft but durable material that dampens and dissipates impact energy associated with a moderate drop, thereby reducing the magnitude of shock forces transmitted to the electronic device housed inside the protective case 100 at a moment of impact and immediately thereafter.

The back portion 110 can be made of any suitable material, including, but not limited to, polycarbonate (PC), high impact polystyrene (HIPS), nylon, fiberglass-filled nylon, acrylonitrile butadiene styrene (ABS), polyoxymethylene (POM), polyethylene terephthalate (PET), aluminum, aluminum alloy, titanium, wood, carbon fiber, or any combination thereof. Similar to first layer 140 of the front portion 105, the back portion 110 can bolster the structural rigidity of the protective case 100 to enable the protective case to withstand a moderate drop (e.g. from a height of about 3-6 feet) without experiencing significant physical deformation upon impact, thereby ensuring that unwanted separation of the front portion 105 from the back portion does not occur at impact.

Figure 15:
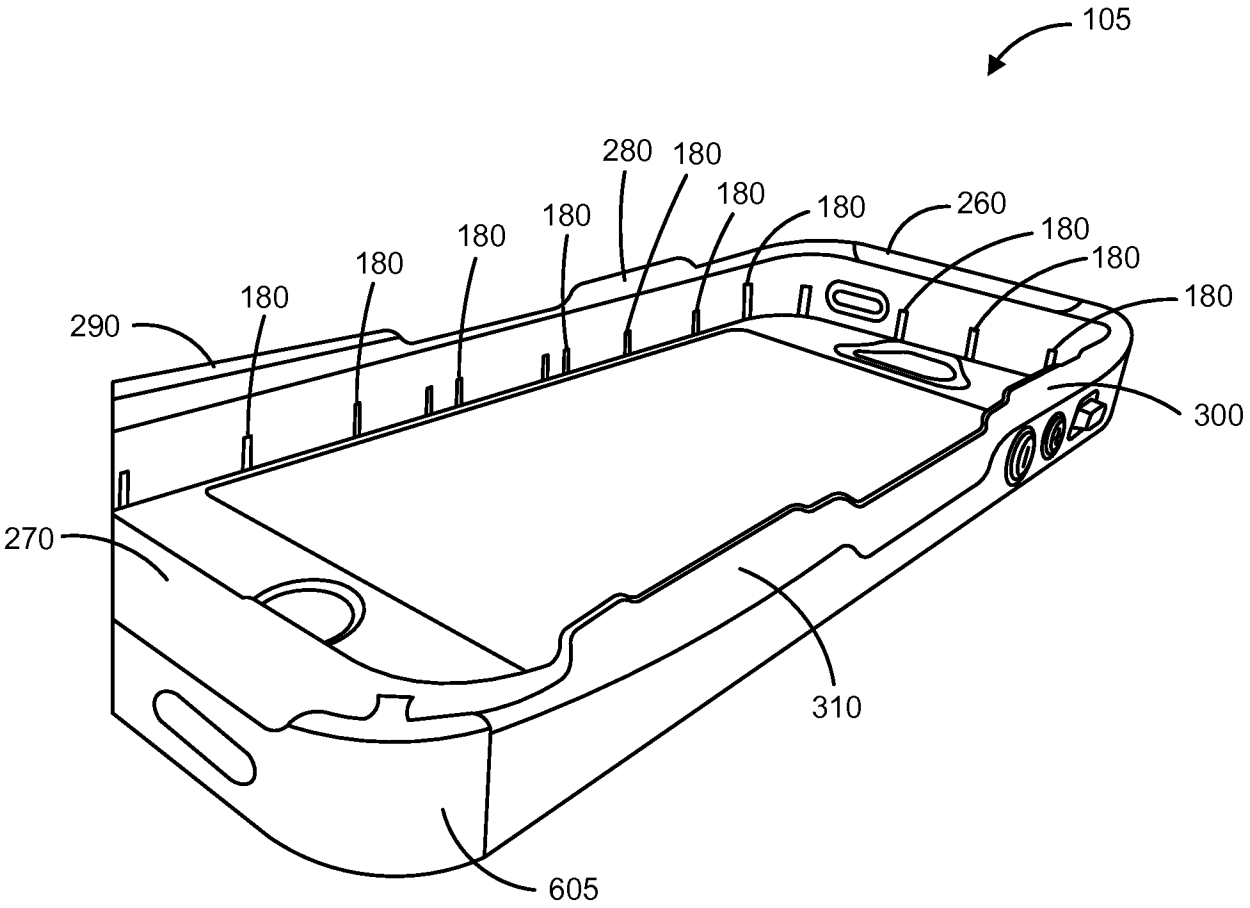
FIG. 15 is a partial back perspective view of the front portion of the protective case of FIG. 1.

The protective case 100 can include a plurality of relatively soft protrusions 180 on the inner surfaces of the cavity 150, as shown in FIG. 15. The protrusions 180 can improve the fit of the personal electronic device within the cavity 150. For instance, respective protrusions 180 can compress toward the inner surfaces (e.g. 160, 165, 170, and 175) of the cavity 150 when the electronic device is installed in the cavity, thereby taking up any gap between the device and the inner surfaces of the cavity 150. This permits the cavity 150 to be manufactured with a tolerance that is less restrictive than a tolerance that would be required if the cavity 150 were required to fit snugly around the device. This approach reduces manufacturing costs, since a higher percentage of manufactured front portions 110 will meet design specifications, thereby reducing the number of rejected parts and resultant waste. In addition to manufacturing considerations, the protrusions 180 serve a second important function; they isolate the electronic device from the inner surfaces of the cavity 150. As a result, an air gap is provided around the side surfaces of the electronic device. The air gaps prevent impact forces from being transmitted directly from the first layer 140 of the front portion 105 to the electronic device. The air gaps also prevent the side surfaces of the electronic device from becoming marred as a result of constant contact and minor positional shifting relative to the harder and less forgiving surfaces (e.g. 155, 160, 165, 170, 175) of the cavity 150 of the first layer 140 of the front portion 105. Consequently, the exterior condition of the electronic device is not degraded over time, which permits higher resale of the device when a user, for example, sells the device and upgrades to a newer model device.

Figure 17:
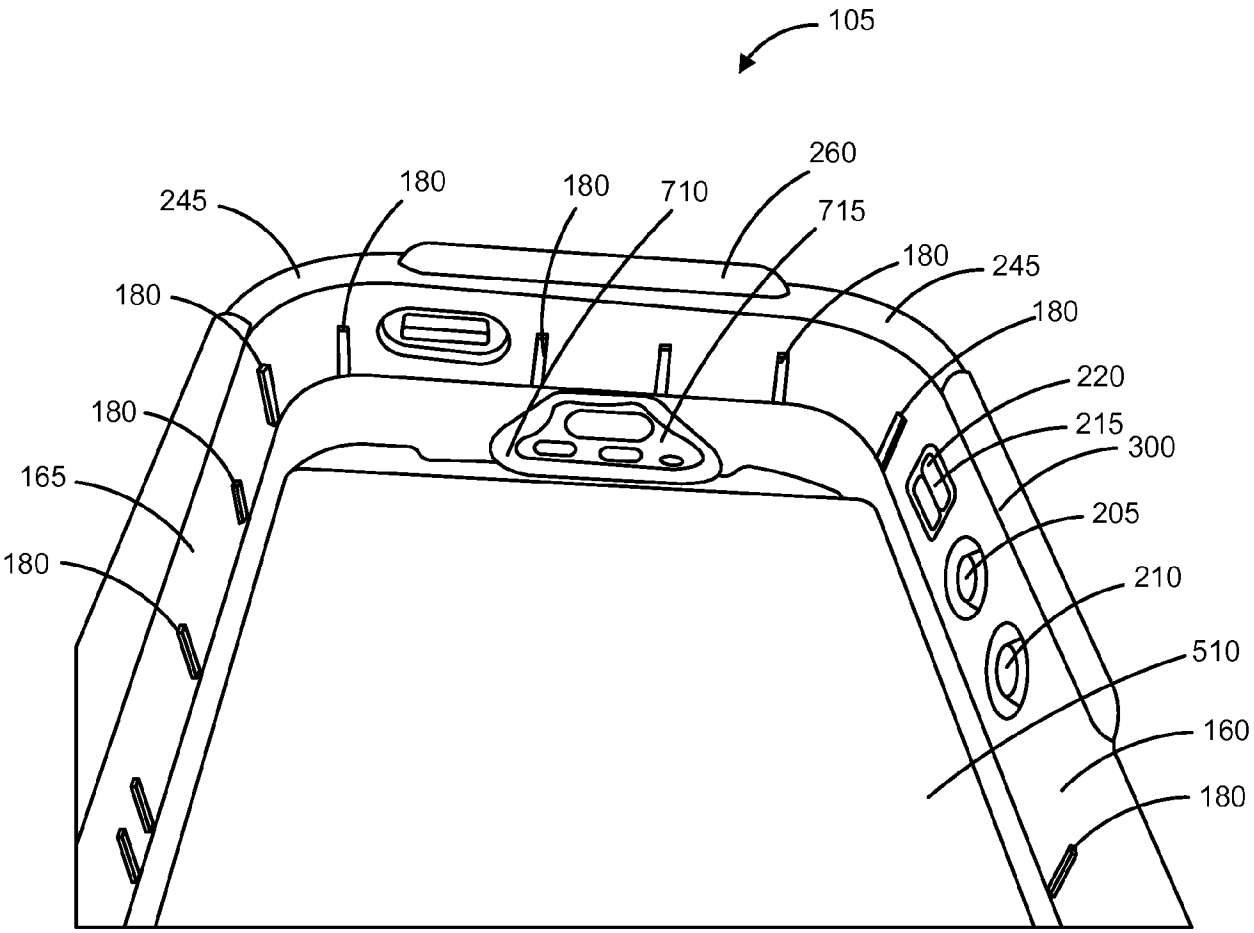
FIG. 17 is a partial back perspective view of an upper end of the front portion of the protective case of FIG. 1.
Figure 18:
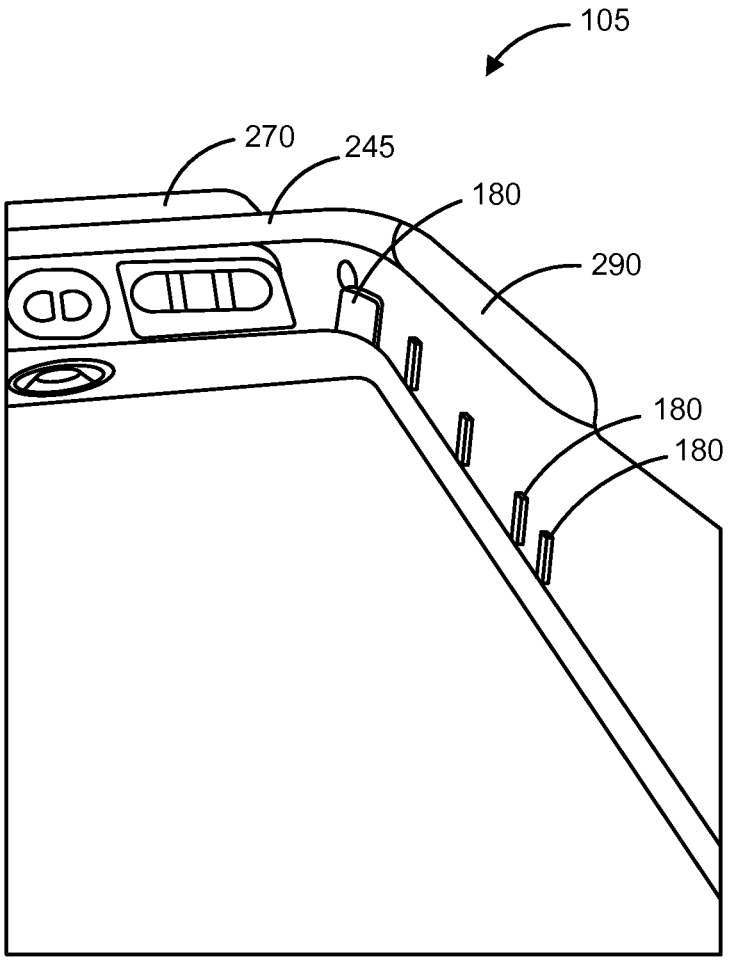
FIG. 18 is a partial back perspective view of the lower right corner of the front portion of the protective case of FIG. 1.
Figure 20:
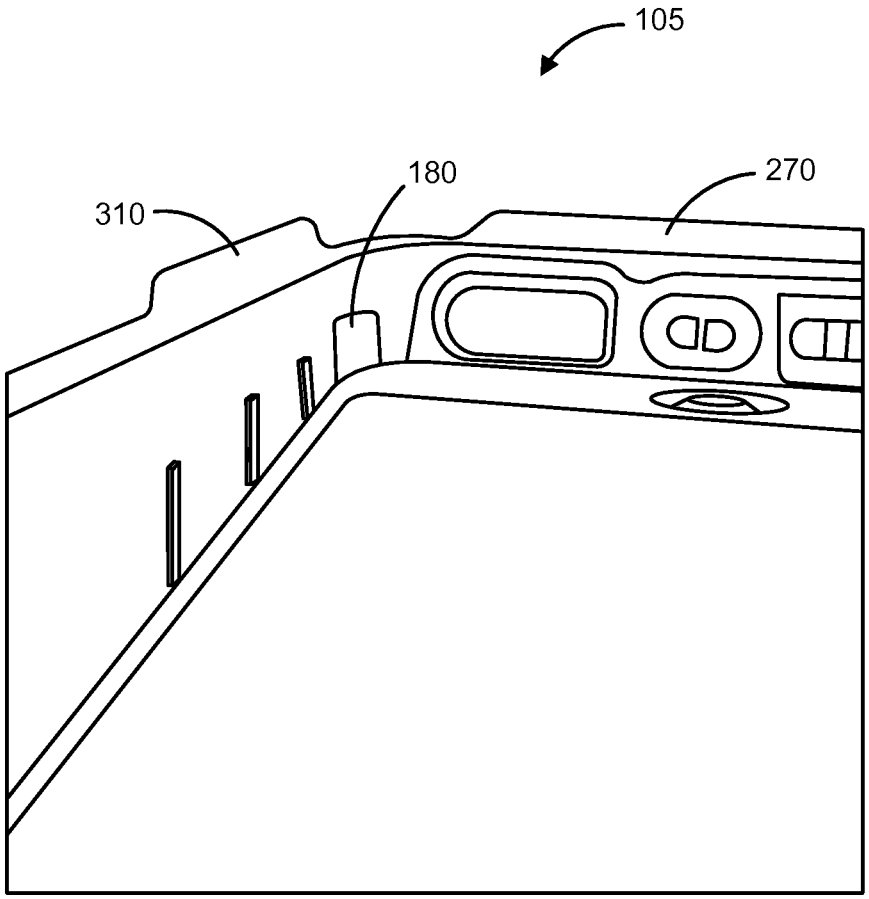
FIG. 20 is a partial back perspective view of a lower left corner of the front portion of the protective case of FIG. 1.
Figure 21:
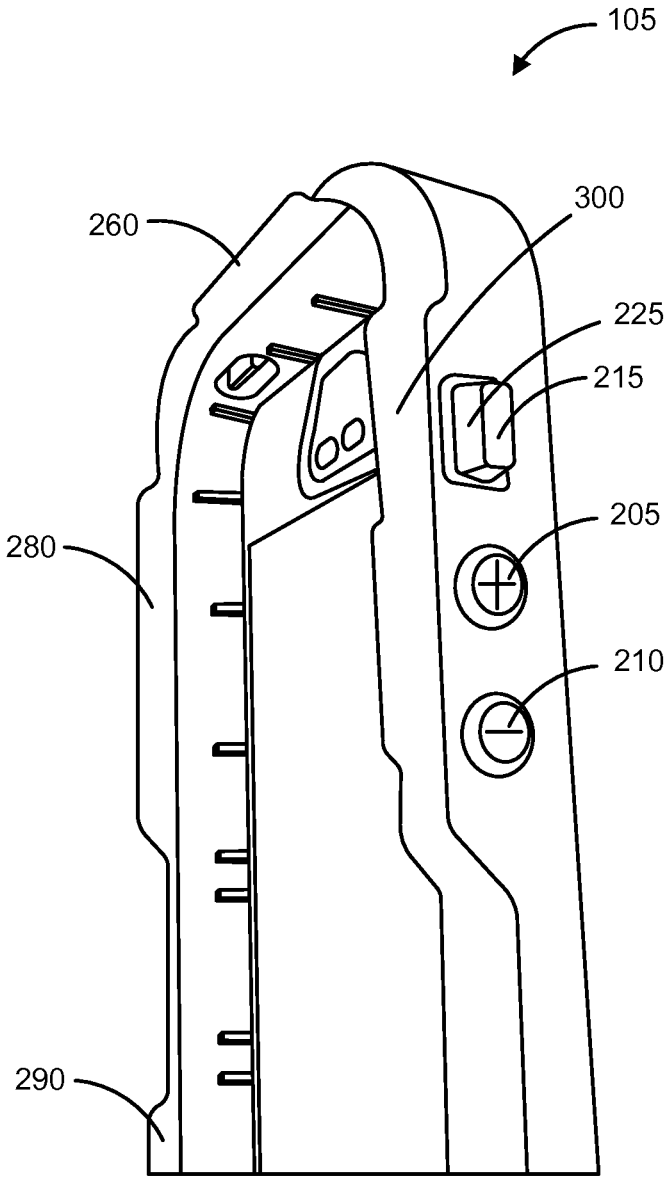
FIG. 21 is a partial back perspective view of the front portion of the protective case of FIG. 1.

As shown in FIG. 17, the inner left side surface 160 can include a plurality of protrusions 180 that extend inward toward the cavity 150 and can be configured to contact a left side surface of the electronic device. The inner right side surface 165 can include a plurality of protrusions 180 that extend inward toward the cavity 150 and that can be configured to contact a right side surface of the electronic device. The inner top side surface 170 can include a plurality of protrusions 180 that extend inward toward the cavity 150 and can be configured to contact a top side surface of the electronic device. As shown in FIGS. 18 and 20, the inner bottom side surface 175 can include a plurality of protrusions 180 that extend inward toward the cavity 150 and can be configured to contact a bottom side surface of the electronic device.

FIG. 17 shows a first button feature 205, a second button feature 210, and a third button feature 215. The first and second button features (205, 210) can be configured to engage a first volume button and a second volume button, respectively, on a left side surface of the electronic device. The front portion 105 can include openings in the first layer 140 to accommodate the first and second button features (205, 210), and the first and second button features can be formed in the second layer 145, as shown in FIGS. 17 and 20. The first and second button features (205, 210) can flex inward toward the cavity 150 when the user applies force to an outer surface of one of the button features, thereby permitting actuation of the respective button on the electronic device. The third button 215 feature can include a rocker switch feature configured to engage a rocker switch, such as a mute rocker switch, on the left side of the device. The rocker switch feature 115 can include an engagement feature 220 formed in the first layer 140, as shown in FIG. 17. The engagement feature 220 can be flexibly coupled to the front portion 105 by a flexible hinge 225. The flexible hinge 225 can be formed in the second layer 145. During manufacturing, thin gates can be formed to permit flow of the second layer 145 material to the engagement feature 220. The thin gates can then easily be broken by actuating the third button feature 215 during a first use. As a result, the engagement feature decouples entirely from the first layer 140 and resides only in the second layer 145, where it can easily be actuated by the user.

Figure 16:
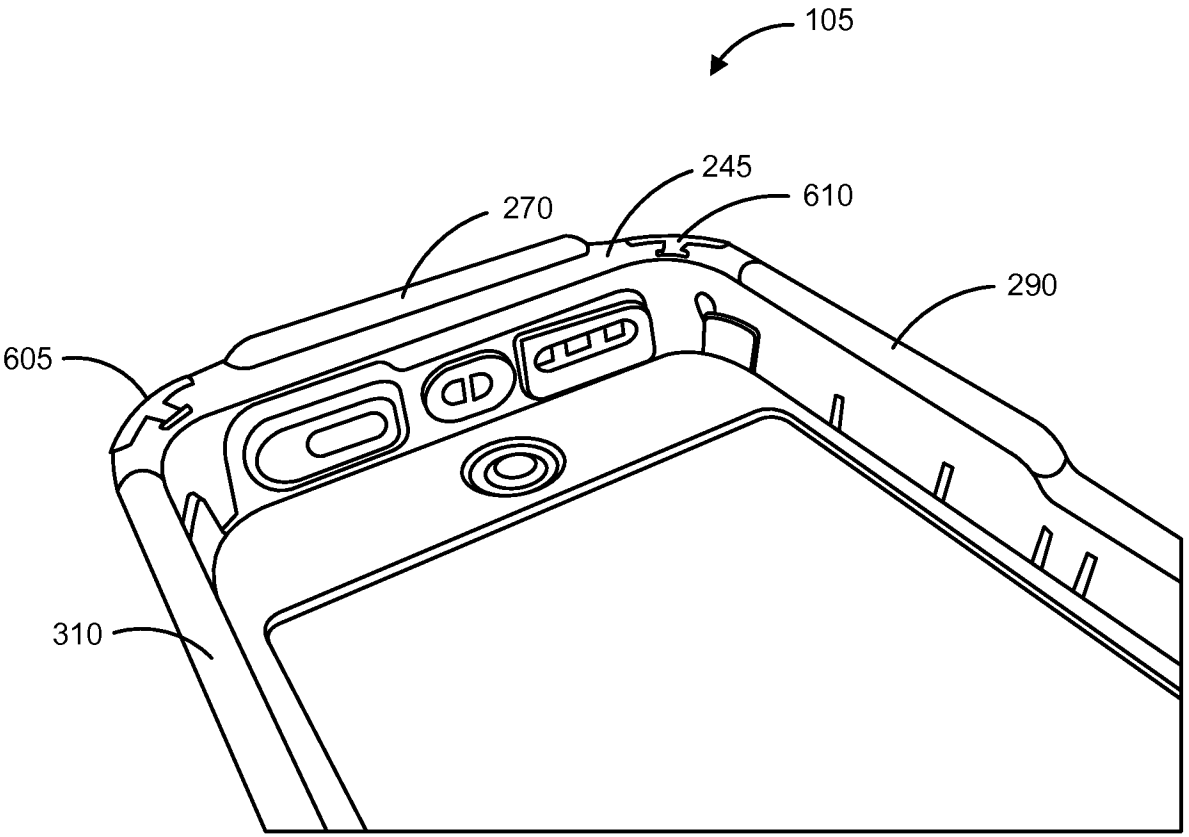
FIG. 16 is a partial back perspective view of a bottom end of the front portion of the protective case of FIG. 1.
Figure 24:
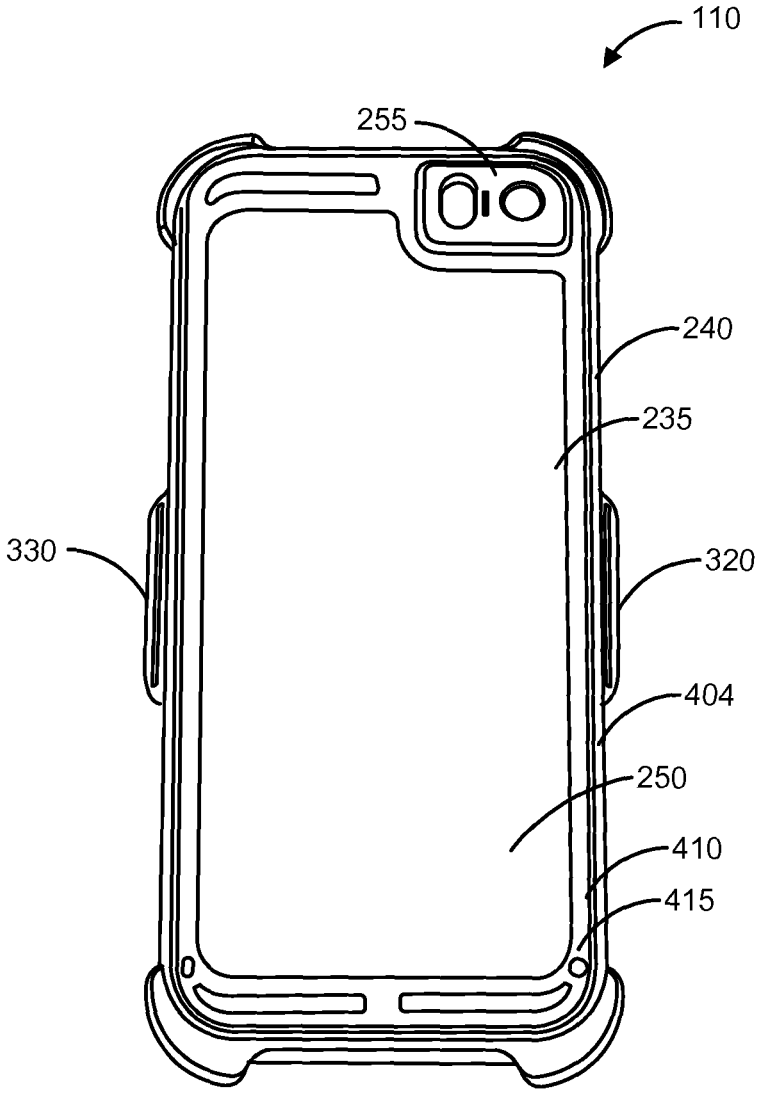
FIG. 24 is a front view of the back portion of the protective case of FIG. 1.

The back portion 110 can include an inner back surface 235 and an outer back surface 230. As shown in FIG. 24, the inner back surface 235 can include an overmolded gasket 240 extending around a perimeter of the back portion 110. The overmolded gasket 240 can establish a liquid-tight seal between the front portion 105 and the back portion 110 when the front and back portions are assembled to form a waterproof protective case 100. In one example, the overmolded gasket 240 can be made of a thermoplastic elastomer. As shown in FIGS. 16 and 17, the front portion 105 can include a mating surface 245 that is configured to mate against the overmolded gasket 240 when the back portion 110 is attached to the front portion 105. The seal formed between the overmolded gasket 240 and the mating surface 245 on the front portion 105 can be a water-resistant seal. During assembly of the front portion 105 to the back portion 100, the mating surface 245 can provide a compressive force against the overmolded gasket 240, thereby compressing the overmolded gasket 240 and ensuring a water-resistant seal.

Figure 26:
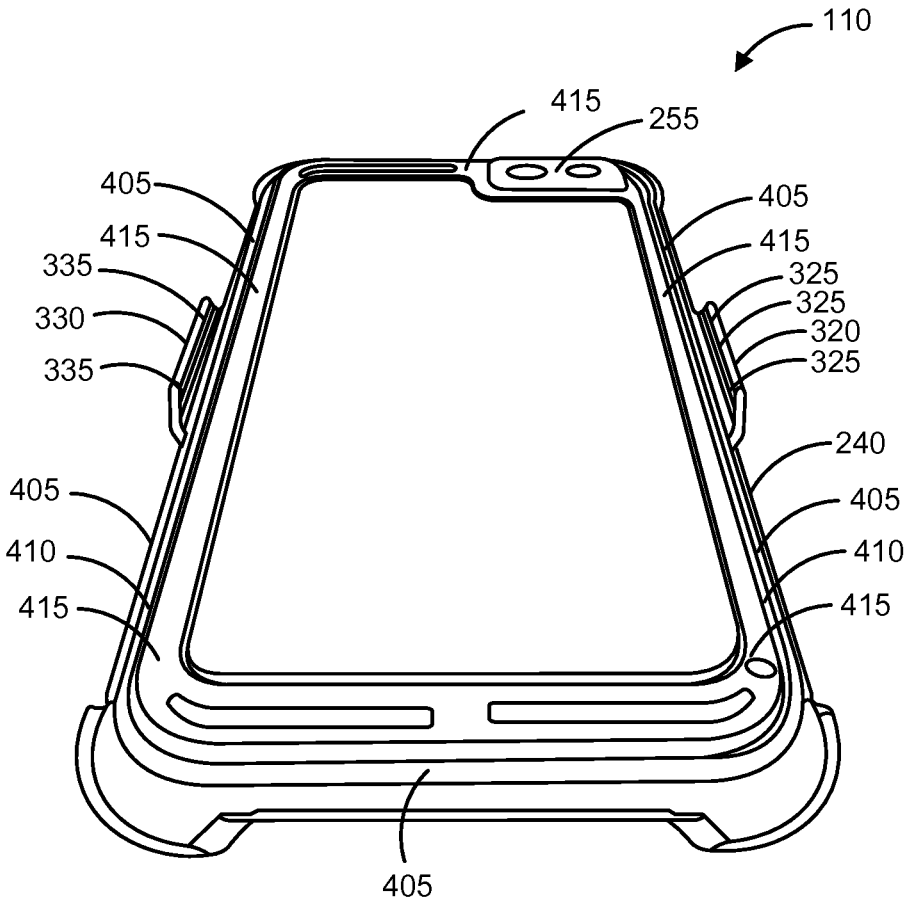
FIG. 26 is a front perspective view of the back portion of the protective case of FIG. 1.

The overmolded gasket 240 can include a flexible sealing surface 405 configured to mate against the sealing surface 245 of the front portion 105. As shown in FIG. 26, the overmolded gasket 240 can include a groove 410 located between the flexible sealing surface 405 and an inner gasket portion 415. The groove 410 can permit flexing of the flexible sealing surface 405 during assembly to provide a water-resistant seal between the flexible sealing surface and the sealing surface 245 of the front portion 105. The inner gasket portion 415 may not seal against the sealing surface of the front portion 105. Instead, the inner gasket portion 415 may improve manufacturability of the overmolded gasket. The inner gasket portion 415 can also enhance adhesion between the overmolded gasket 240 and the inner back surface 235 of the back portion 110 due to the greater contact area between the overmolded gasket and the inner back surface 235. Consequently, the inner gasket portion 415 can enhance durability and longevity of the overmolded gasket 240.

As shown in FIG. 24, the back portion 110 can include a foam layer 250 adhered to the inner back surface 235. The foam layer 250 can isolate the personal electronic device from the inner back surface 235 of the back portion 210. The foam layer 250 can provide impact protection by isolating the electronic device form the inner back surface 235 of the back portion 110, thereby preventing impact forces from being directly transmitted to the device. The foam layer 250 can be made of any suitable foam material. In some example, the foam layer 250 can be made of open cell foam or closed cell foam. In some examples, the foam layer 250 can be made of urethane foam or microcellular urethane foam, such as PORON.

As shown in FIG. 24, the back portion 110 can include a camera flash isolator 255. When the electronic device is installed in the protective case 100, the camera flash isolator 255 can be located between a camera and a flash on a back side surface of the electronic device. In one example, the camera flash isolator can include a foam layer adhered to an inner back surface 235 of the back portion 110. The foam layer can provide a light barrier between the camera and the flash and can extend from a back side surface of the electronic device to the inner back surface 235 of the back portion 110. When a user takes a flash photo with the electronic device, the camera flash isolator 255 can prevent light emitted from the flash from reflecting off of the inner back surface 235 of the back portion 110 toward the camera, where the reflected light would result in unwanted artifacts (e.g. aberrations) or blurriness in the photo image captured by the device.

Figure 4:
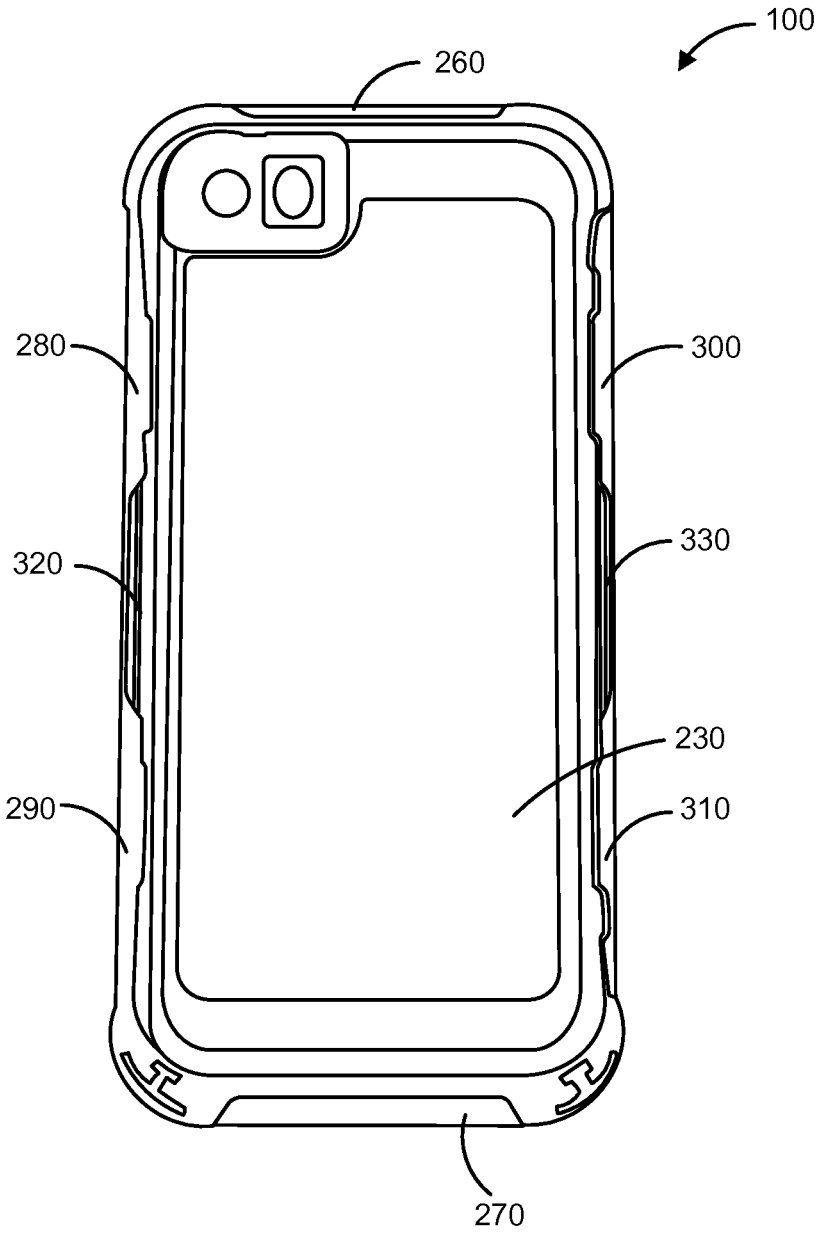
FIG. 4 is a back view of the protective case of FIG. 1.
Figure 9:
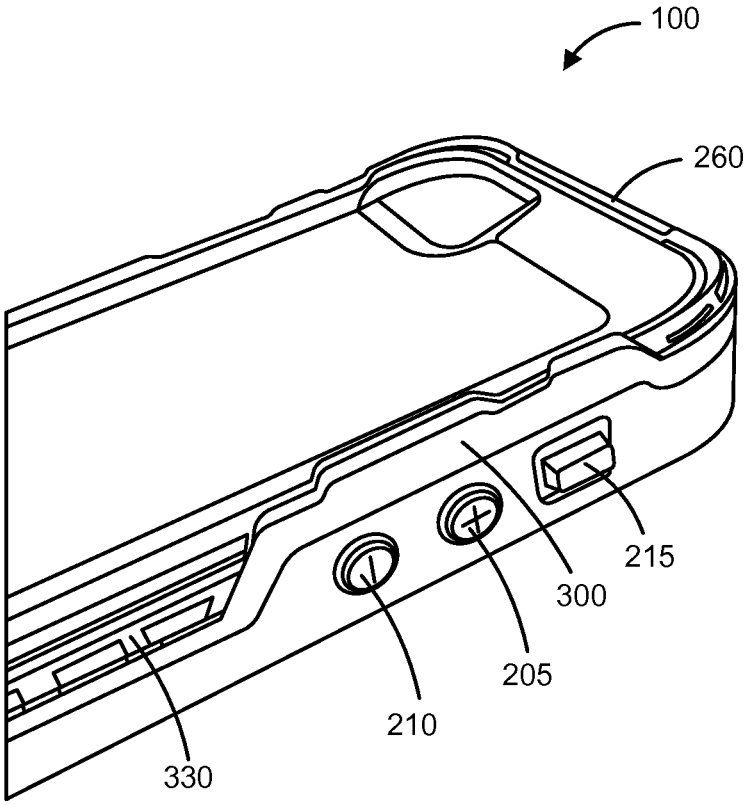
FIG. 9 is a partial back perspective view of the protective case of FIG. 1.
Figure 10:
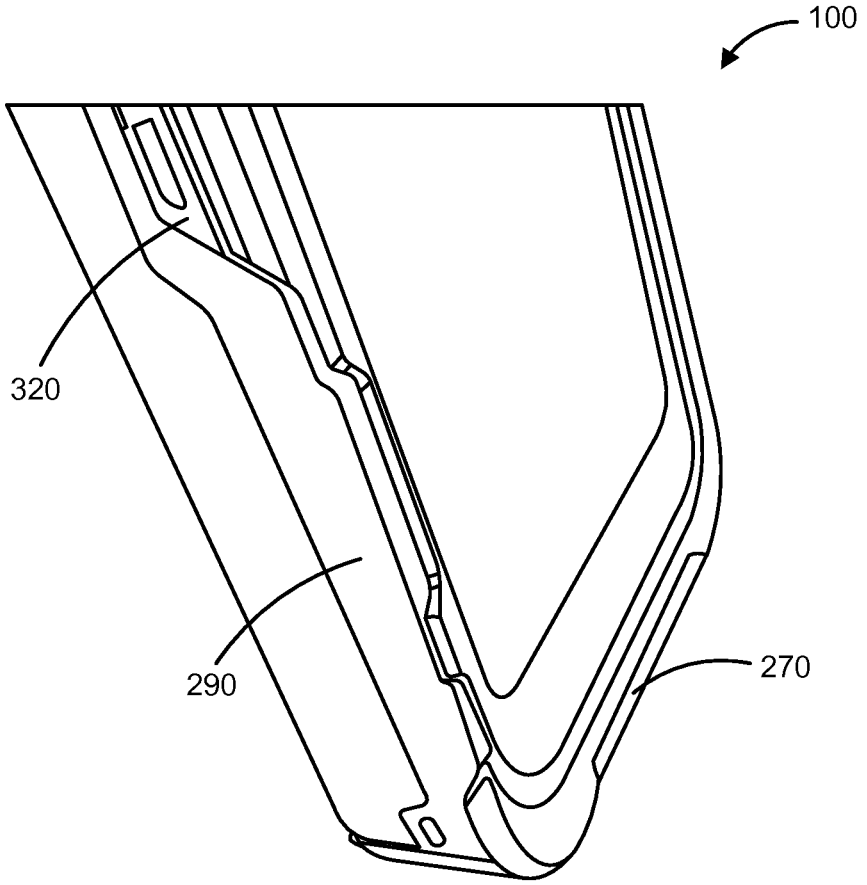
FIG. 10 is a partial back perspective view of the protective case of FIG. 1.
Figure 22:
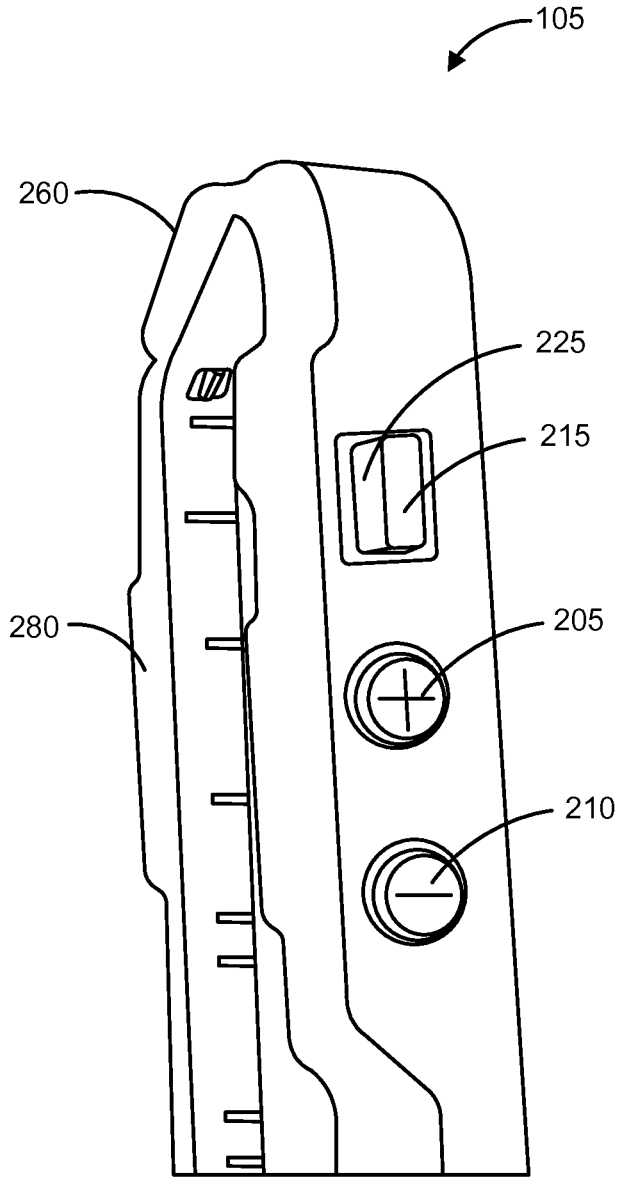
FIG. 22 is a partial back perspective view of the front portion of the protective case of FIG. 1.
Figure 23:
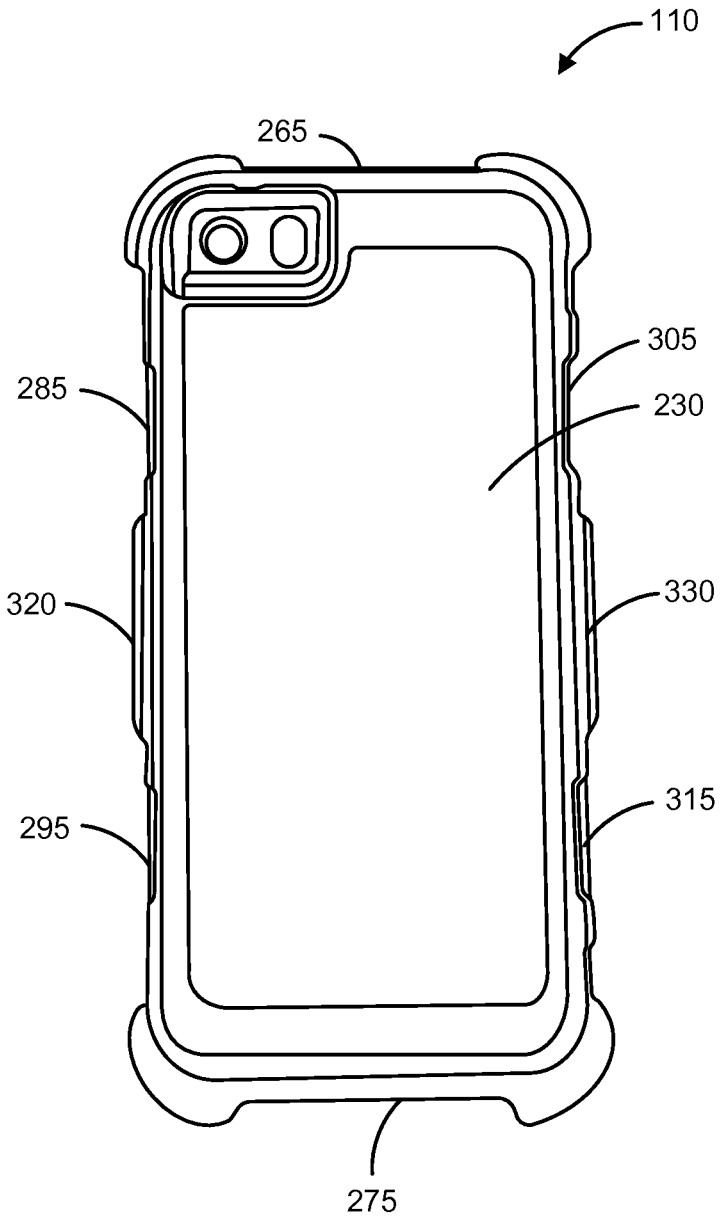
FIG. 23 is a back view of the back portion of the protective case of FIG. 1.
Figure 25:
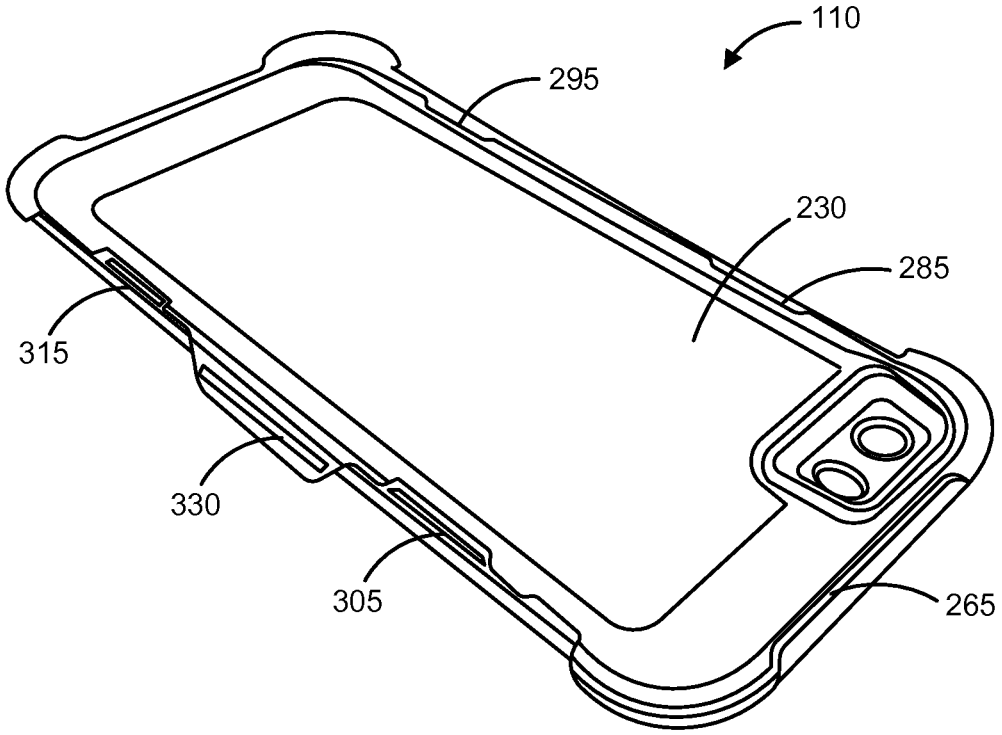
FIG. 25 is a back perspective view of the back portion of the protective case of FIG. 1.

As shown in FIGS. 17 and 22, the front portion 105 can include a top side clasping feature 260 extending from the top side surface 120. The back portion 110 can include a first clasping surface 265 on the back side surface 230, as shown in FIGS. 23 and 25. The top side clasping feature 260 can engage the first clasping surface 265, as shown in FIGS. 4 and 9. The first clasping surface 265 can be oriented at an angle of approximately 30-60, 40-50, or 45 degrees inward with respect to a first plane that is coplanar with the top side surface 120 of the front portion 105 when the front portion is attached to the back portion 110.

Figure 1:
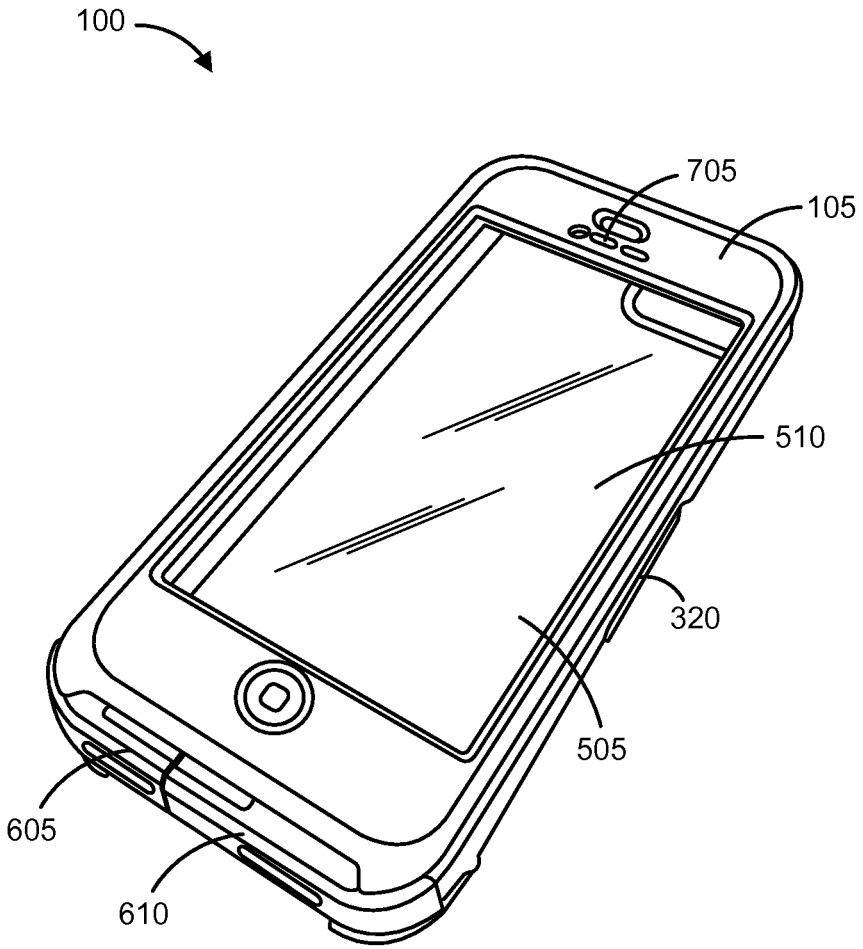
FIG. 1 is a front perspective view of a first embodiment of a protective case for an electronic device.
Figure 2:
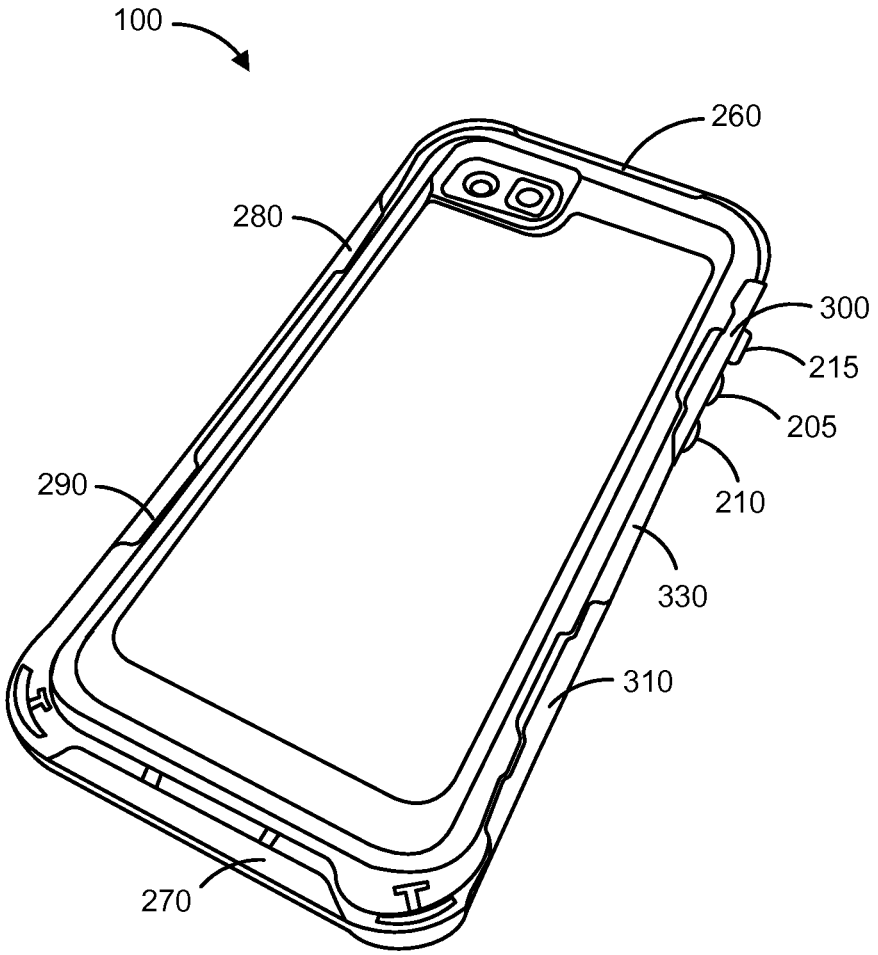
FIG. 2 is a back perspective view of the protective case of FIG. 1.
Figure 11:
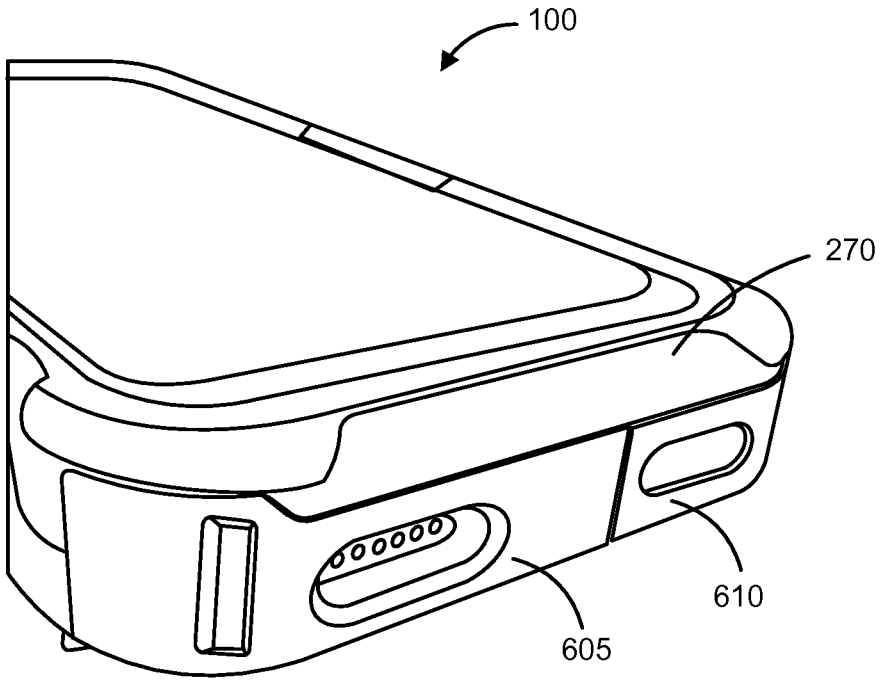
FIG. 11 is a partial bottom perspective view of the protective case of FIG. 1.
Figure 27:
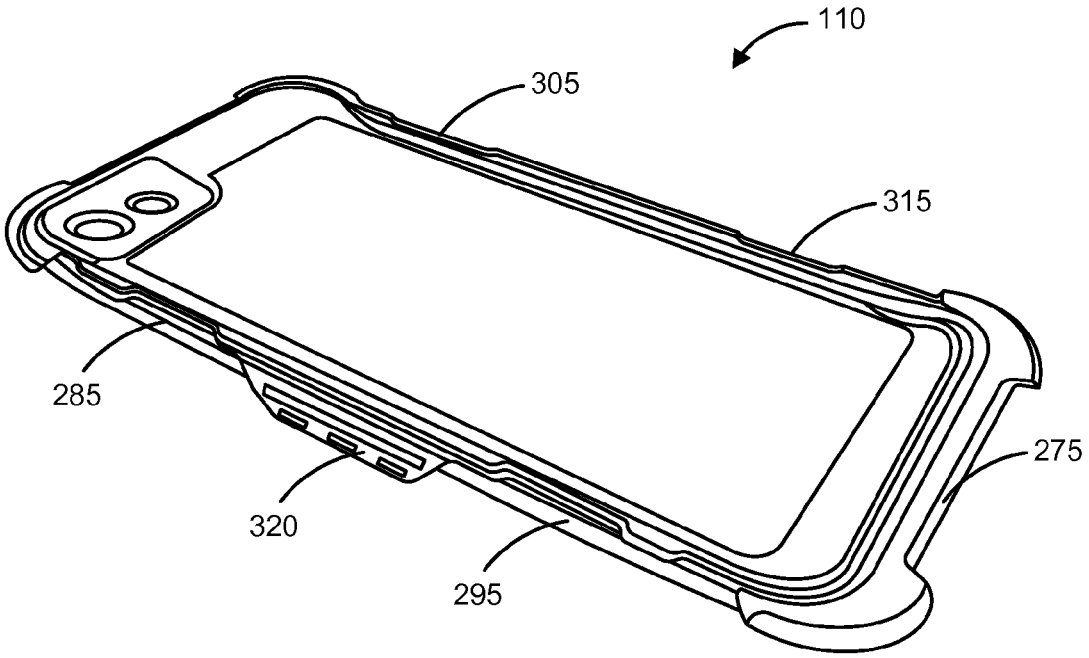
FIG. 27 is a back perspective view of the back portion of the protective case of FIG. 1.

As shown in FIGS. 14-16 and 18, the front portion 105 can include a bottom side clasping feature 270 extending from the bottom side surface 125. The back portion 110 can include a second clasping surface 275 on the back side surface 230, as shown in FIGS. 23 and 27. The bottom side clasping feature 270 can engage the second clasping surface 275, as shown in FIGS. 2, 4, and 11. The second clasping surface 275 can be oriented at an angle of approximately 30-60, 40-50, or 45 degrees inward with respect to a second plane that is coplanar with the bottom side surface 125 of the front portion 105 when the front portion is attached to the back portion 110.

Figure 12:
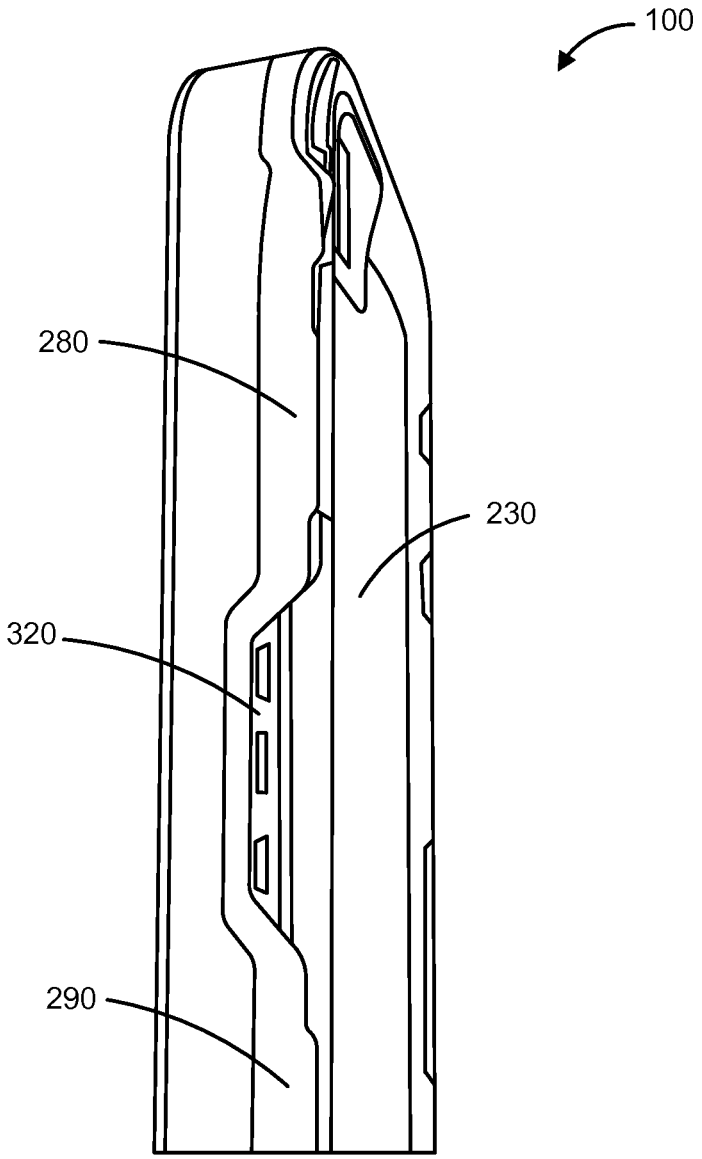
FIG. 12 is a partial right side rear perspective view of the protective case of FIG. 1.
Figure 19:
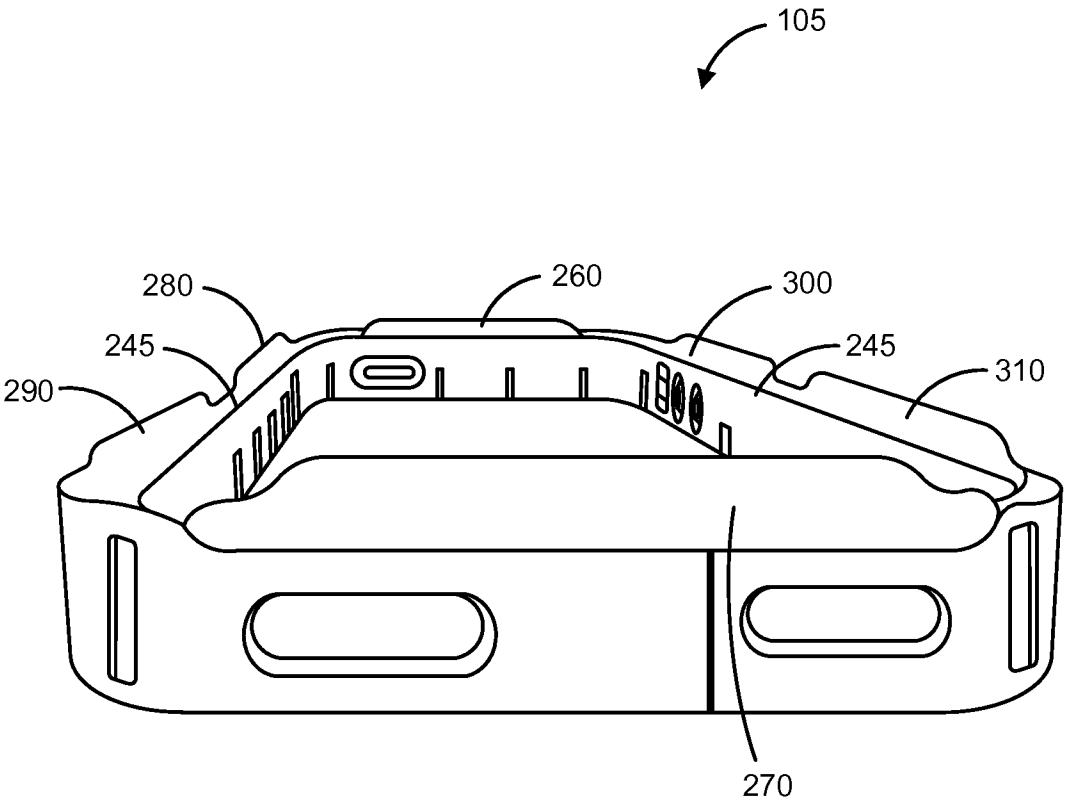
FIG. 19 is a bottom perspective view of the front portion of the protective case of FIG. 1.

As shown in FIGS. 14 and 19, the front portion 105 can include a first right side clasping feature 280 extending from the right side surface 135. The back portion 110 can include a third clasping surface 285 on the back side surface 230, as shown in FIGS. 23 and 27. The first right side clasping feature 280 can engage the third clasping surface 285, as shown in FIGS. 4 and 12. The third clasping surface 285 can be oriented at an angle of approximately 30-60, 40-50, or 45 degrees inward with respect to a third plane that is coplanar with the right side surface 135 of the front portion 105 when the front portion is attached to the back portion 110.

As shown in FIGS. 14 and 19, the front portion 105 can include a second right side clasping feature 290 extending from the right side surface 135. The back portion 110 can include a fourth clasping surface 295 on the back side surface 230, as shown in FIGS. 23 and 27. The second right side clasping feature 290 can engage the fourth clasping surface 295, as shown in FIGS. 4 and 12. The fourth clasping surface 295 can be oriented at an angle of approximately 30-60, 40-50, or 45 degrees inward with respect to the third plane that is coplanar with the right side surface 135 of the front portion 105 when the front portion is attached to the back portion 110.

As shown in FIGS. 14 and 17, the front portion 105 can include a first left side clasping feature 300 extending from the left side surface 130. The back portion 110 can include a fifth clasping surface 305 on the back side surface 230, as shown in FIGS. 23 and 25. The first left side clasping feature 300 can engage the fifth clasping surface 305, as shown in FIGS. 4 and 9. The fifth clasping surface 305 can be oriented at an angle of approximately 30-60, 40-50, or 45 degrees inward with respect to a fourth plane that is coplanar with the left side surface 130 of the front portion 105 when the front portion is attached to the back portion 110.

As shown in FIGS. 14 and 15, the front portion 105 can include a second left side clasping feature 310 extending from the left side surface 130. The back portion 110 can include a sixth clasping surface 315 on the back side surface 230, as shown in FIGS. 23 and 25. The second left side clasping feature 310 can engage the sixth clasping surface 315, as shown in FIG. 4. The sixth clasping surface 315 can be oriented at an angle of approximately 30-60, 40-50, or 45 degrees inward with respect to the fourth plane that is coplanar with the left side surface 130 of the front portion 105 when the front portion is attached to the back portion 110.

The back portion 110 can include a right side retention feature 320 extending from a right side edge of the back portion, as shown in FIG. 12. The right side retention feature 320 can be oriented at an angle of approximately 90 degrees with respect to a fifth plane that is coplanar with the outer back surface 230 of the back portion 110. The right side retention feature 320 can include an outer surface and an inner surface opposite the inner surface. The right side retention feature 320 can include one or more detents 325, as shown in FIG. 26, extending from the inner surface toward the cavity 150 when the front portion 105 is attached to the back portion 110. The front portion 105 can include one or more recesses on the right side surface 135, and the recesses can be configured to receive the one or more detents when the front portion is attached to the back portion 110.

The back portion 110 can include a left side retention feature 330 extending from a left side edge of the back portion, as shown in FIGS. 4 and 9. The left side retention feature 330 can be oriented at an angle of approximately 90 degrees with respect to the fifth plane that is coplanar with the outer back surface 230 of the back portion 110. The right side retention feature 330 can include an outer surface and an inner surface opposite the inner surface. The left side retention feature 330 can include one or more detents 335, as shown in FIG. 26, extending from the inner surface toward the cavity 150 when the front portion 105 is attached to the back portion 110. The front portion 105 can include one or more recesses on the left side surface 130, and the one or more recesses can be configured to receive the one or more detents 335 when the front portion is attached to the back portion 110.

Figure 5:
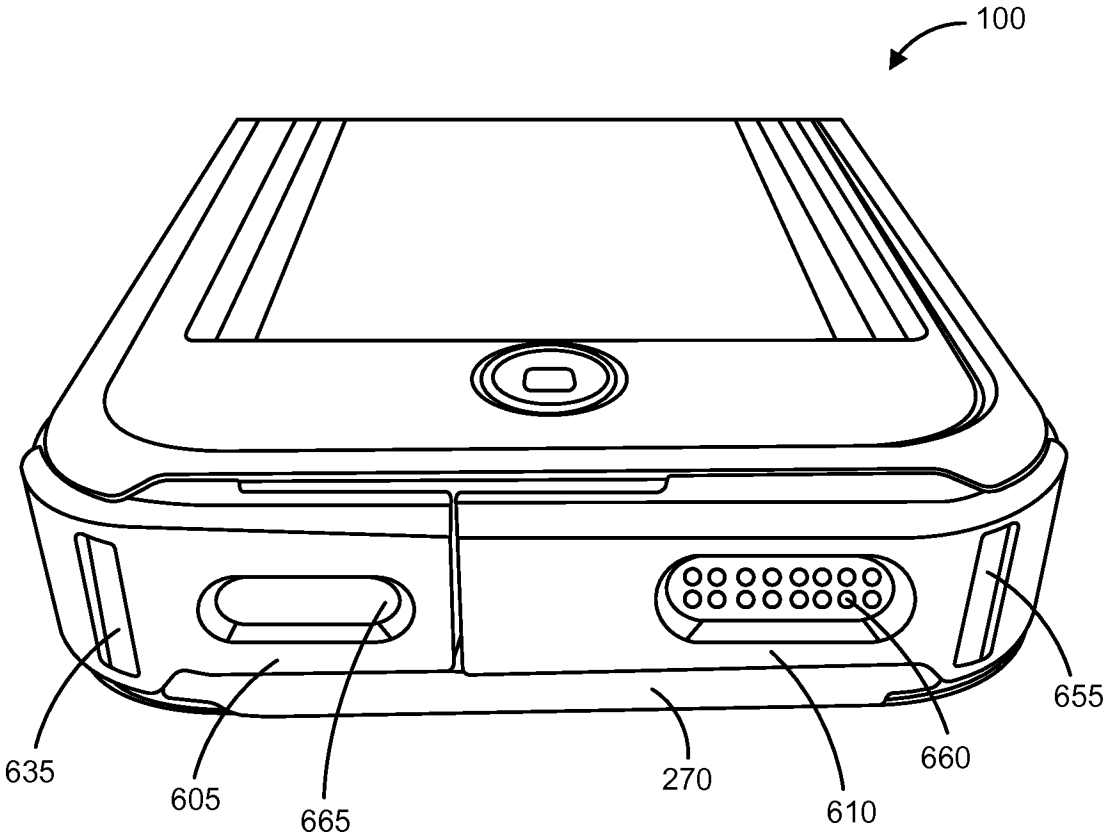
FIG. 5 is a bottom perspective view of the protective case of FIG. 1.
Figure 6:
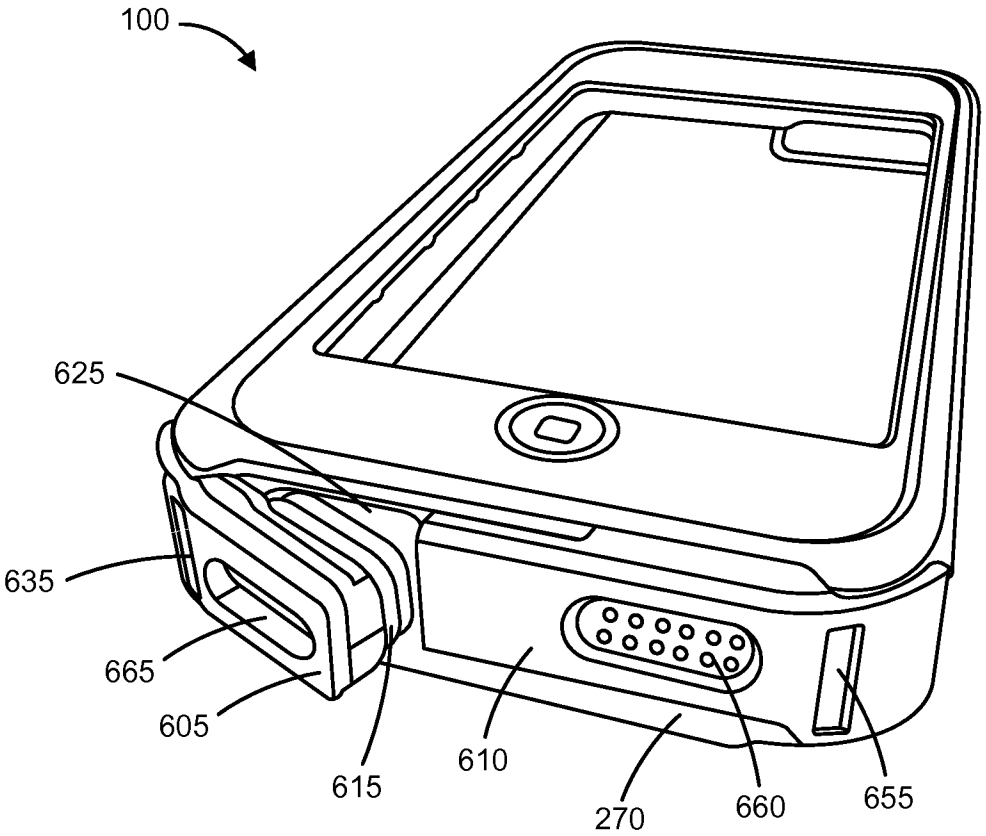
FIG. 6 is a bottom perspective view of the protective case of FIG. 1 showing a first port cover in a partially open position.

The front portion 105 can include a first port cover 605 flexibly attached to the bottom side 125 of the front portion, as shown in FIGS. 5 and 13. The first port cover 605 can be configured to cover and seal a first port opening 625 in the bottom side of the front portion 105, as shown in FIG. 6. The first port cover 605 can include a first O-ring 615 configured to seal against an inner surface of the first port opening 625 to provide a water-resistant seal when the first port cover is in a closed position. When in an open position, the first port cover 605 can provide access to features of the personal electronic device through the first port opening 625. In one example, the first port cover 605 can be attached to the front portion 105 by inserting a feature of the first port cover into a slot 630 in the front portion, as shown in FIG. 14. The first port cover 605 can include a first hinge 635, as shown in FIG. 5, to permit flexing of the first port cover during opening and closing. In one example, the first hinge 635 can be a portion of the first port cover 605 having a relatively thinner cross-sectional area than adjacent portions of the port cover. When the first port cover 605 is in a closed position, it can permit sound to pass through the first port opening 625. In one example, the first port cover 605 can include an opening 665 that is covered with an acoustic membrane (e.g. an acoustic membrane made of GORE-TEX) that permits sound transmission.

Figure 7:
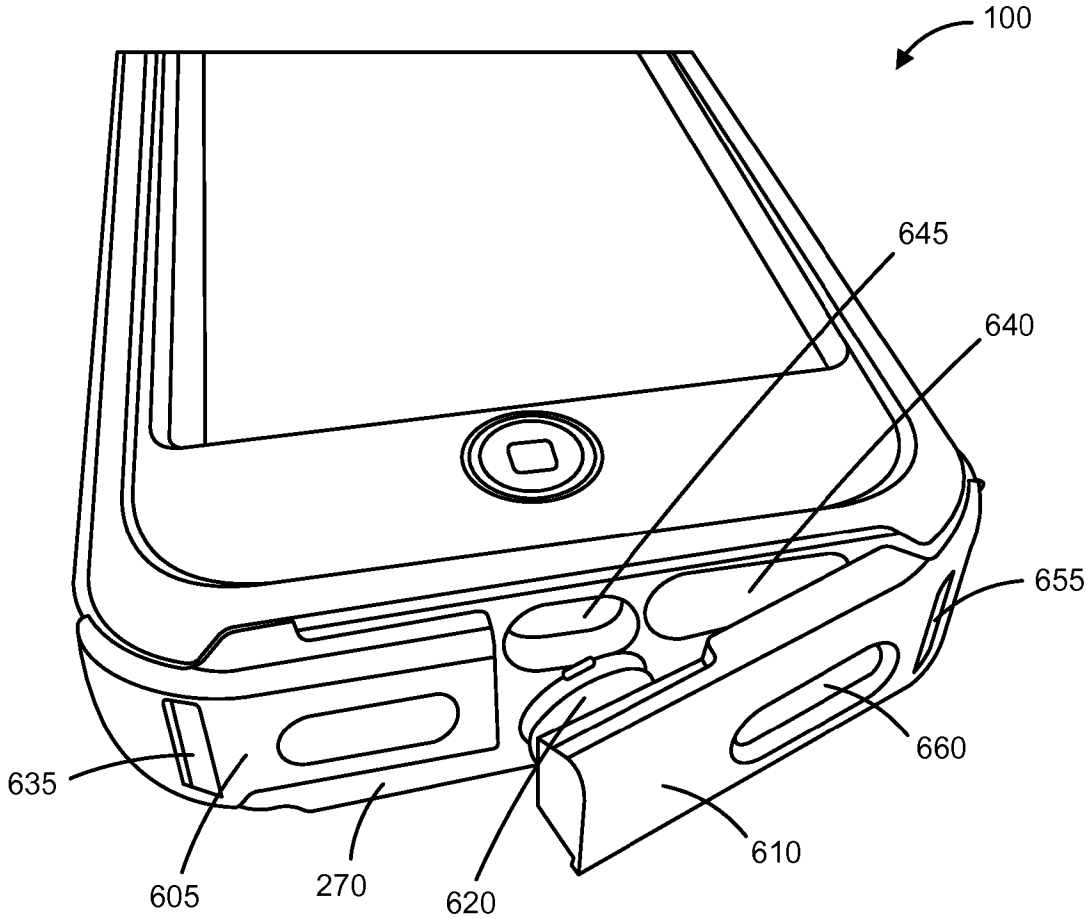
FIG. 7 is a bottom perspective view of the protective case of FIG. 1 showing a second port cover in a partially open position.
Figure 8:
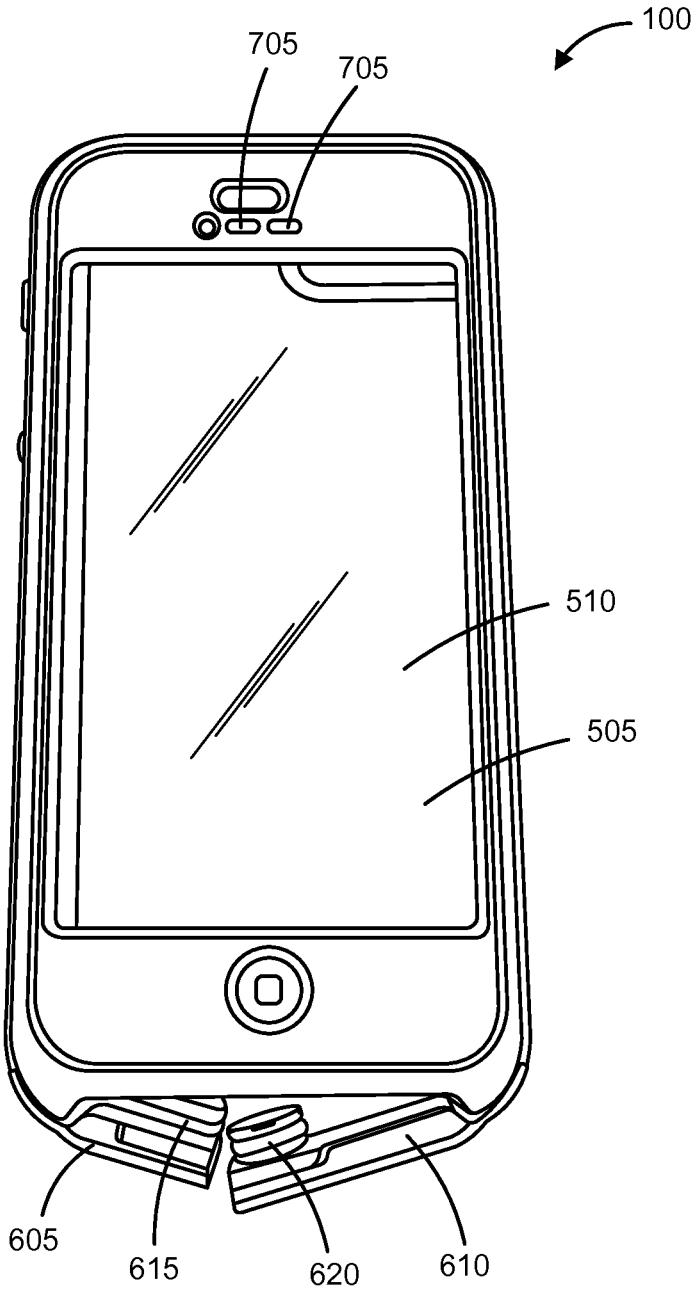
FIG. 8 is a front view of the protective case of FIG. 1 showing the first and second port covers in partially open positions.

The front portion 105 can include a second port cover 610 flexibly attached to the bottom side 125 of the front portion, as shown in FIGS. 5 and 13. The second port cover 610 can be configured to cover and seal a second port opening 640 in the bottom side of the front portion 105, as shown in FIG. 7. The second port cover 610 can also be configured to cover and seal a third port opening 645 in the bottom side of the front portion 105. The second port cover 610 can include a first O-ring 620 configured to seal against an inner surface of the third port opening 645 to provide a water-resistant seal when the second port cover is in a closed position. When in an open position, the second port cover 610 can provide access to features of the personal electronic device through the second and third port openings (640, 645). In one example, the second port cover 610 can be attached to the front portion 105 by inserting a feature of the second port cover into a slot 650 in the front portion, as shown in FIG. 14. The second port cover 610 can include a second hinge 655, as shown in FIG. 5, to permit flexing of the second port cover during opening and closing. In one example, the second hinge 655 can be a portion of the second port cover 610 having a relatively thinner cross-sectional area than adjacent portions of the port cover. When the second port cover 610 is in a closed position, it can permit sound to pass through the second port opening 640. In one example, the second port cover 605 can include an opening 660 extending to the second port opening 640, as shown in FIG. 7, and the second port opening can be covered with an acoustic membrane (e.g. an acoustic membrane made of GORE-TEX) that permits sound transmission.

Figure 3:
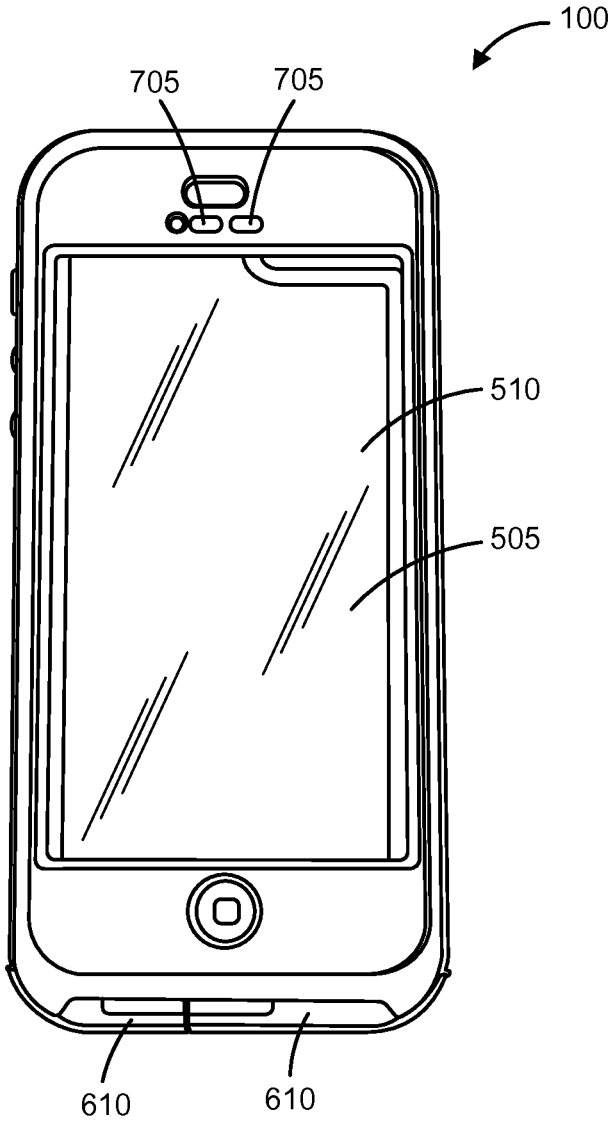
FIG. 3 is a front view of the protective case of FIG. 1.

The front portion 105 can include one or more speaker openings 705, as shown in FIG. 3. Each speaker opening 705 can be covered with a thin mesh layer to protect the speaker of the electronic device from physical damage, such as being punctured by a slender item (a key, paperclip, or pine needle) that inadvertently penetrates the speaker opening. The mesh layer can be covered with an acoustic membrane 715 that permits sound transmission, such as an acoustic membrane made of, for example, GORE-TEX, as shown in FIG. 17.

The front portion 105 can include a sound isolator 710 extending around the speaker opening. The sound isolator 710 can be adhered to an inner surface of the membrane 510. The sound isolator 710 can surround and isolate the speaker on a front surface of the personal electronic device and can be compressed against the front surface of the electronic device when the electronic device is installed in the protective case. The sound isolator 710 can prevent unwanted sounds, such as reverberations or echoes that occur within the protective case, from diminishing call quality. The sound isolator 710 provides significantly improved voice quality (e.g. clarity and volume) when compared to other commercially-available waterproof cases for smartphones.

FIG. 28 shows a second embodiment of a protective case 800 for an electronic device. The protective case 800 includes an overmolded gasket 240 that covers substantially the entire inner back surface 235 of the back portion 110. By covering substantially the entire inner back surface 235 with the overmolded gasket 240, no foam layer is needed, so manufacturing can be simplified by eliminating a manufacturing step and one component. The overmolded gasket 240 can provide impact protection and can prevent the electronic device from directly contacting the inner back surface 235 of the back portion 110, thereby serving a similar function as the foam layer it replaces. The overmolded gasket 805 can enhance the stiffness of the back portion 110, which can prevent flexing of the back portion and unwanted opening of the protective case 800 during an impact event, such as when the protective case is inadvertently dropped onto a hard surface.

As shown in Section A-A of FIG. 28, the overmolded gasket 240 can include a flexible sealing surface 405 configured to mate against the sealing surface 245 of the front portion 105. The overmolded gasket 240 can include a groove 410 located between the flexible sealing surface 405 and an inner gasket portion 415, which can cover substantially the entire inner back surface 235 of the back portion 110. The groove 410 can permit flexing of the flexible sealing surface 405 during assembly to provide a water-resistant seal between the flexible sealing surface and the sealing surface 245 of the front portion 105.

As shown in Section A-A of FIG. 28, the second layer 145 of the front portion 105 can be overmolded on the first layer 140 of the first portion. The second left side clasping feature 310 can extend from the left side surface 130 of the front portion 105. A sixth clasping surface 315 can be located on the back side surface 230 of the back portion 110. The second left side clasping feature 310 can engage the sixth clasping surface 315. The sixth clasping surface 315 can be oriented at an angle of approximately 30-60, 40-50, or 45 degrees inward with respect to the fourth plane that is coplanar with the left side surface 130 of the front portion 105 when the front portion is attached to the back portion 110.

FIG. 29 shows a third embodiment of a protective case 850 for an electronic device. As an alternative to an overmolded gasket, the protective case 850 can include a form-in-place gasket 855. The form-in-place gasket 855 can extend around the perimeter of the inner back surface 235 of the back portion 110. The form-in-place gasket 855 can include a flexible sealing surface 405 configured to mate against the sealing surface 245 of the front portion 105. The protective case 800 can include a foam layer 250, including any suitable material. In one example, the foam layer 250 can be made of urethane foam, and more specifically, a micro-cellular urethane foam such as PORON.

FIG. 30 shows a fourth embodiment of a protective case 900 for an electronic device. As an alternative to an overmolded gasket or a form-in-place gasket, the protective case 850 can include a removable O-ring 905. The O-ring 905 can extend around the perimeter of the inner back surface 235 of the back portion 110. The O-ring 905 can be installed in a channel 910 extending around the perimeter of the inner back surface 235 of the back portion 110, as shown in Section C-C. The O-ring 905 can include a flexible sealing surface 405 configured to mate against the sealing surface 245 of the front portion 105. The protective case 800 can include a foam layer 250, including any suitable material. In one example, the foam layer 250 can be made of urethane foam, and more specifically, a micro-cellular urethane foam such as PORON.

The foregoing description has been presented for purposes of illustration and description. It is not intended to be exhaustive or to limit the claims to the embodiments disclosed. Other modifications and variations may be possible in view of the above teachings. The embodiments were chosen and described to explain the principles of the invention and its practical application to enable others skilled in the art to best utilize the invention in various embodiments and various modifications as are suited to the particular use contemplated. It is intended that the claims be construed to include other alternative embodiments of the invention except insofar as limited by the prior art.

What is claimed is:

1. A waterproof protective case for a personal electronic device, the protective case comprising:

a front portion comprising a front side surface, a left side surface, a right side surface, a top side surface, and a bottom side surface, a cavity configured to receive the personal electronic device, the cavity defined by an inner front side surface, an inner left side surface, an inner right side surface, an inner top side surface, and an inner bottom side surface, a mating surface extending around a perimeter of the cavity, a top side clasping feature extending from the top side surface, the top side clasping feature oriented at an angle of approximately 45 degrees inward with respect to a first plane that is coplanar with the top side surface, and a bottom side clasping feature extending from the bottom side surface, the bottom side clasping feature oriented at an angle of approximately 45 degrees inward with respect to a second plane that is coplanar with bottom side surface; and a back portion configured to attach to the front portion to encapsulate the personal electronic device when the personal electronic device is installed in the protective case, the back portion comprising an inner back surface and an outer back surface, wherein the inner back surface comprises an overmolded gasket extending around the perimeter of the inner back surface, the overmolded gasket comprising a flexible sealing surface configured to provide a liquid-tight seal between the mating surface of the front portion and the flexible sealing surface when the back portion is attached to the front portion, a top side clasping surface configured to engage the top side clasping feature on the front portion, the top side clasping surface being oriented at an angle of approximately 45 degrees inward with respect to the first plane when the front portion is attached to the back portion, a bottom side clasping surface configured to engage the bottom side clasping feature on the front portion, the bottom side clasping surface being oriented at an angle of approximately 45 degrees inward with respect to the second plane when the front portion is attached to the back portion.

2. The protective case of claim 1, wherein the overmolded gasket further comprises a groove between the flexible sealing surface and an inner gasket portion, wherein the groove is configured to permit flexing of the flexible sealing surface to provide a water-resistant seal.

3. The protective case of claim 1, wherein the front portion further comprises:

a right side clasping feature extending from the right side surface, wherein the right side clasping feature is configured to engage a right side clasping surface on the back portion, the right side clasping surface of the back portion being positioned proximate the right side surface of the front portion when the front portion is attached to the back portion; and a left side clasping feature extending from the left side surface, wherein the left side clasping feature is configured to engage a left side clasping surface on the back portion, the left side clasping surface of the back portion being positioned proximate the left side surface of the front portion when the front portion is attached to the back portion.

4. The protective case of claim 3, wherein the right side clasping surface is oriented at an angle of approximately 45 degrees inward with respect to a third plane that is coplanar with the right side surface of the front portion when the front portion is attached to the back portion, and wherein the left side clasping surface is oriented at an angle of approximately 45 degrees inward with respect to a fourth plane that is coplanar with the left side surface of the front portion when the front portion is attached to the back portion.

5. The protective case of claim 1, wherein the back portion further comprises:

a right side retention feature extending from a right side edge of the back portion, wherein the right side retention feature is oriented at an angle of approximately 90 degrees with respect to a fifth plane that is coplanar with the outer back surface of the back portion, wherein the right side retention feature comprises an outer surface and an inner surface opposite the inner surface, and wherein the right side retention feature comprises a first detent extending from the inner surface toward the cavity when the front portion is attached to the back portion, the right side retention feature being positioned proximate the right side surface of the front portion when the front portion is attached to the back portion; and a left side retention feature extending from a left side edge of the back portion, wherein the left side retention feature is oriented at an angle of approximately 90 degrees with respect to the fifth plane, wherein the left side retention feature comprises an outer surface and an inner surface opposite the inner surface, and wherein the left side retention feature comprises a second detent extending from the inner surface toward the cavity when the front portion is attached to the back portion, the left side retention feature being positioned proximate the left side surface of the front portion when the front portion is attached to the back portion.

6. The protective case of claim 5, wherein the front portion comprises a first recess on the right side surface, and wherein the first recess is configured to receive the first detent when the front portion is attached to the back portion, and wherein the front portion comprises a second recess on the left side surface, and wherein the second recess is configured to receive the second detent when the front portion is attached to the back portion.

7. The protective case of claim 1, further comprising a foam layer adhered to the inner back surface of the back portion, wherein the foam layer is configured to contact a back side surface of the personal electronic device when installed in the protective case.

8. The protective case of claim 1, wherein the inner left side surface, the inner right side surface, the inner bottom surface, and the inner top surface of the cavity in the front portion each comprise a plurality of overmolded protrusions configured to contact a surface of the personal electronic device when the personal electronic device is installed in the cavity.

9. The protective case of claim 1, wherein the front portion further comprises a speaker opening covered with an acoustic membrane and a sound isolator extending around the speaker opening, wherein the sound isolator is adhered to an inner surface of the acoustic membrane and is configured to surround and isolate a speaker on a front surface of the personal electronic device.

10. A waterproof protective case for a personal electronic device, the protective case comprising:

a front portion comprising a front side surface, a left side surface, a right side surface, a top side surface, and a bottom side surface, a cavity configured to receive the personal electronic device, the cavity defined by an inner front side surface, an inner left side surface, an inner right side surface, an inner top side surface, and an inner bottom side surface, and a mating surface extending around a perimeter of the cavity, a top side clasping feature extending from the top side surface, the top side clasping feature oriented at an angle of approximately 45 degrees inward with respect to a first plane that is coplanar with the top side surface, and a bottom side clasping feature extending from the bottom side surface, the bottom side clasping feature oriented at an angle of approximately 45 degrees inward with respect to a second plane that is coplanar with bottom side surface; and a back portion configured to attach to the front portion to encapsulate the personal electronic device when the personal electronic device is installed in the protective case, the back portion comprising an inner back surface and an outer back surface, the inner back surface comprising a form-in-place gasket extending around the perimeter of the inner back surface, and wherein the form-in-place gasket comprises a flexible sealing surface that is configured to provide a liquid-tight seal between the mating surface of the front portion and the flexible sealing surface when the back portion is attached to the front portion, a top side clasping surface configured to engage the top side clasping feature on the front portion, the top side clasping surface being oriented at an angle of approximately 45 degrees inward with respect to the first plane when the front portion is attached to the back portion, and a bottom side clasping surface configured to engage the bottom side clasping feature on the front portion, the bottom side clasping surface being oriented at an angle of approximately 45 degrees inward with respect to the second plane when the front portion is attached to the back portion.

11. The protective case of claim 10, wherein the front portion further comprises:

a right side clasping feature extending from the right side surface, wherein the right side clasping feature is configured to engage a right side clasping surface on the back portion, the right side clasping surface of the back portion being positioned proximate the right side surface of the front portion when the front portion is attached to the back portion; and a left side clasping feature extending from the left side surface, wherein the left side clasping feature is configured to engage a left side clasping surface on the back portion, the left side clasping surface of the back portion being positioned proximate the left side surface of the front portion when the front portion is attached to the back portion.

12. The protective case of claim 11, wherein the right side clasping surface is oriented at an angle of approximately 45 degrees inward with respect to a third plane that is coplanar with the right side surface of the front portion when the front portion is attached to the back portion, and wherein the left side clasping surface is oriented at an angle of approximately 45 degrees inward with respect to a fourth plane that is coplanar with the left side surface of the front portion when the front portion is attached to the back portion.

13. The protective case of claim 10, wherein the back portion further comprises:

a right side retention feature extending from a right side edge of the back portion, wherein the right side retention feature is oriented at an angle of approximately 90 degrees with respect to a fifth plane that is coplanar with the outer back surface of the back portion, wherein the right side retention feature comprises an outer surface and an inner surface opposite the inner surface, and wherein the right side retention feature comprises a first detent extending from the inner surface toward the cavity when the front portion is attached to the back portion, the right side retention feature being positioned proximate the right side surface of the front portion when the front portion is attached to the back portion; and a left side retention feature extending from a left side edge of the back portion, wherein the left side retention feature is oriented at an angle of approximately 90 degrees with respect to the fifth plane, wherein the left side retention feature comprises an outer surface and an inner surface opposite the inner surface, and wherein the left side retention feature comprises a second detent extending from the inner surface toward the cavity when the front portion is attached to the back portion, the left side retention feature being positioned proximate the left side surface of the front portion when the front portion is attached to the back portion.

14. The protective case of claim 13, wherein the front portion comprises a first recess on the right side surface, and wherein the first recess is configured to receive the first detent when the front portion is attached to the back portion, and wherein the front portion comprises a second recess on the left side surface, and wherein the second recess is configured to receive the second detent when the front portion is attached to the back portion.

15. The protective case of claim 10, wherein the inner left side surface, the inner right side surface, the inner bottom surface, and the inner top surface of the cavity in the front portion each comprise a plurality of overmolded protrusions configured to contact a surface of the personal electronic device when the personal electronic device is installed in the cavity.

16. The protective case of claim 10, wherein the front portion further comprises a speaker opening covered with an acoustic membrane and a sound isolator extending around the speaker opening, wherein the sound isolator is adhered to an inner surface of the acoustic membrane and is configured to surround and isolate a speaker on a front surface of the personal electronic device.

17. A waterproof protective case for a personal electronic device, the protective case comprising:

a front portion comprising a front side surface, a left side surface, a right side surface, a top side surface, and a bottom side surface, a cavity configured to receive the personal electronic device, the cavity defined by an inner front side surface, an inner left side surface, an inner right side surface, an inner top side surface, and an inner bottom side surface, a mating surface extending around a perimeter of the cavity, a right side clasping feature extending from the top side surface, the right side clasping feature oriented at an angle of approximately 45 degrees inward with respect to a first plane that is coplanar with the right side surface, and a left side clasping feature extending from the left side surface, the left side clasping feature oriented at an angle of approximately 45 degrees inward with respect to a second plane that is coplanar with left side surface; and a back portion configured to attach to the front portion to encapsulate the personal electronic device when the personal electronic device is installed in the protective case, the back portion comprising an inner back surface and an outer back surface, wherein the inner back surface comprises a gasket extending around the perimeter of the inner back surface, the gasket having a flexible sealing surface configured to provide a liquid-tight seal between the mating surface of the front portion and the flexible sealing surface when the back portion is attached to the front portion, a right side clasping surface configured to engage the right side clasping feature on the back portion when the front portion is attached to the back portion, the right side clasping surface of the back portion being positioned proximate the right side surface of the front portion when the front portion is attached to the back portion, and a left side clasping surface configured to engage the left side clasping feature on the back portion, the left side clasping surface of the back portion being positioned proximate the left side surface of the front portion when the front portion is attached to the back portion.

18. The protective case of claim 17, wherein the gasket further comprises a groove between the flexible sealing surface and an inner gasket portion, wherein the groove is configured to permit flexing of the flexible sealing surface to provide a water-resistant seal.

19. The protective case of claim 17, wherein the front portion further comprises:

a top side clasping feature extending from the front side surface, wherein the top side clasping feature is configured to engage a top side clasping surface on the front portion; and a bottom side clasping feature extending from the bottom side surface, wherein the bottom side clasping feature is configured to engage a bottom side clasping surface on the front portion.

20. The protective case of claim 19, wherein the top side clasping surface is oriented at an angle of approximately 45 degrees inward with respect to a third plane that is coplanar with the top side surface of the front portion when the front portion is attached to the back portion, and wherein the bottom side clasping surface is oriented at an angle of approximately 45 degrees inward with respect to a fourth plane that is coplanar with the bottom side surface of the front portion when the front portion is attached to the back portion.

* * * * *